US010367280B2

(12) United States Patent
Lloyd et al.

(10) Patent No.: US 10,367,280 B2
(45) Date of Patent: Jul. 30, 2019

(54) WIRE TO BOARD CONNECTORS SUITABLE FOR USE IN BYPASS ROUTING ASSEMBLIES

(71) Applicant: Molex, LLC, Lisle, IL (US)

(72) Inventors: Brian Keith Lloyd, Maumelle (AR); Gregory B. Walz, Maumelle (AR); Bruce Reed, Maumelle (AR); Gregory Fitzgerald, Merrimack, NH (US); Ayman Isaac, Little Rock, AR (US); Kent E. Regnier, Lombard, IL (US); Brandon Janowiak, Wheaton, IL (US); Darian R. Schulz, Little Rock, AR (US); Munawar Ahmad, Maumelle (AR); Eran J. Jones, Conway, AR (US); Javier Resendez, Streamwood, IL (US); Michael Rost, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/541,208

(22) PCT Filed: Jan. 11, 2016

(86) PCT No.: PCT/US2016/012862

§ 371 (c)(1),
(2) Date: Jun. 30, 2017

(87) PCT Pub. No.: WO2016/112384

PCT Pub. Date: Jul. 14, 2016

(65) Prior Publication Data

US 2018/0034175 A1 Feb. 1, 2018

Related U.S. Application Data

(60) Provisional application No. 62/102,045, filed on Jan. 11, 2015, provisional application No. 62/102,046,
(Continued)

(51) Int. Cl.
*H01R 12/71* (2011.01)
*H01R 12/75* (2011.01)
(Continued)

(52) U.S. Cl.
CPC ..... *H01R 12/714* (2013.01); *H01R 12/71* (2013.01); *H01R 12/716* (2013.01); *H01R 12/75* (2013.01);
(Continued)

(58) Field of Classification Search
CPC .... H01R 12/71; H01R 12/714; H01R 12/716; H01R 12/75; H01R 13/113; H01R 13/6275; H01R 24/22; H01R 24/60
(Continued)

(56) References Cited

U.S. PATENT DOCUMENTS 3,007,131 A 10/1961 Dahlgren et al.
3,594,613 A 7/1971 Prietula
(Continued)

FOREIGN PATENT DOCUMENTS

CN 1316802 A 10/2001
CN 2624465 Y 7/2004
(Continued)

OTHER PUBLICATIONS

Amphenol Aerospace, "Size 8 High Speed Quadrax and Differential Twinax Contacts for Use in MIL-DTL-38999 Special Subminiature Cylindrical and ARINC 600 Rectangular Connectors", published May 2008. Retrieved from www.peigenesis.com/images/content/news/amphenol_quadrax.pdf.
(Continued)

*Primary Examiner* — Edwin A. Leon
*Assistant Examiner* — Oscar C Jimenez
(74) *Attorney, Agent, or Firm* — Molex, LLC

(57) ABSTRACT

A wire to board connector is provided for connecting cables of cable bypass assemblies to circuitry mounted on a circuit
(Continued)

board. The connector has a structure that maintains the geometry of the cable through the connector. The connector includes a pair of edge coupled conductive signal terminals and a ground shield to which the signal terminals are broadside coupled. The connector includes a pair of ground terminals aligned with the signal terminals and both sets of terminals have J-shaped contact portions that flex linearly when the connector is inserted into a receptacle. In another embodiment, the signal terminal contact portions are supported by a compliant member that may deflect when the connectors engage contact pads on a substrate.

26 Claims, 30 Drawing Sheets

Related U.S. Application Data filed on Jan. 11, 2015, provisional application No. 62/102,047, filed on Jan. 11, 2015, provisional application No. 62/102,048, filed on Jan. 11, 2015, provisional application No. 62/156,602, filed on May 4, 2015, provisional application No. 62/156,708, filed on May 4, 2015, provisional application No. 62/167,036, filed on May 27, 2015, provisional application No. 62/182,161, filed on Jun. 19, 2015.

(51) Int. Cl.

| | |
|---|---|
| ***H01R 13/11*** | (2006.01) |
| ***H01R 13/56*** | (2006.01) |
| ***H01R 13/627*** | (2006.01) |
| ***H01R 13/639*** | (2006.01) |
| ***H01R 24/22*** | (2011.01) |
| ***H01R 24/60*** | (2011.01) |

(52) U.S. Cl.
CPC ..... *H01R 13/113* (2013.01); *H01R 13/6275* (2013.01); *H01R 24/22* (2013.01); *H01R 24/60* (2013.01); *H01R 13/567* (2013.01); *H01R 13/639* (2013.01)

(58) Field of Classification Search
USPC ..... 439/108, 289, 497, 579, 607.41
See application file for complete search history.

(56) References Cited

U.S. PATENT DOCUMENTS 3,963,319 A 6/1976 Schumacher et al.
4,025,141 A 5/1977 Thelissen
4,072,387 A * 2/1978 Sochor ..... H01R 23/722 439/329
4,083,615 A 4/1978 Volinskie
4,157,612 A 6/1979 Rainal
4,290,664 A 9/1981 Davis et al.
4,307,926 A 12/1981 Smith
4,346,355 A 8/1982 Tsukii
4,417,779 A * 11/1983 Wilson ..... H01R 12/714 439/325
4,508,403 A 4/1985 Weltman et al.
4,611,186 A 9/1986 Ziegner
4,615,578 A 10/1986 Stadler
4,639,054 A 1/1987 Kersbergen
4,656,441 A 4/1987 Takahashi et al.
4,657,329 A 4/1987 Dechelette
4,679,321 A 7/1987 Plonski
4,697,862 A 10/1987 Hasircoglu
4,724,409 A 2/1988 Lehman
4,889,500 A 12/1989 Lazar
4,924,179 A 5/1990 Sherman
4,948,379 A 8/1990 Evans
4,984,992 A * 1/1991 Beamenderfer ..... H01R 24/30 439/101
4,991,001 A 2/1991 Takubo et al.
5,112,251 A * 5/1992 Cesar ..... H01R 13/6596 439/607.41
5,197,893 A 3/1993 Morlion et al.
5,332,979 A 7/1994 Roskewitsch
5,387,130 A 2/1995 Fedder et al.
5,402,088 A 3/1995 Pierro et al.
5,435,757 A 7/1995 Fedder et al.
5,441,424 A 8/1995 Morlion et al.
5,487,673 A 1/1996 Hurtarte
5,509,827 A 4/1996 Huppenthal et al.
5,554,038 A 9/1996 Morlion et al.
5,598,627 A 2/1997 Saka et al.
5,632,634 A 5/1997 Soes
5,691,506 A 11/1997 Miyazaki et al.
5,781,759 A 7/1998 Kashiwabara
5,784,644 A 7/1998 Larabell
5,813,243 A 9/1998 Johnson et al.
5,876,239 A 3/1999 Morin et al.
6,004,139 A 12/1999 Dramstad
6,053,770 A 4/2000 Blom
6,083,046 A 7/2000 Wu et al.
6,095,872 A 8/2000 Lang
6,098,127 A 8/2000 Kwang
6,144,559 A 11/2000 Johnson et al.
6,156,981 A * 12/2000 Ward ..... H01H 1/403 200/16 D
6,203,376 B1 3/2001 Magajne et al.
6,216,184 B1 4/2001 Fackenhall et al.
6,255,741 B1 7/2001 Yoshihara
6,266,712 B1 7/2001 Henrichs
6,273,753 B1 8/2001 Ko
6,273,758 B1 8/2001 Lloyd
6,366,471 B1 4/2002 Edwards et al.
6,368,120 B1 4/2002 Scherer
6,371,788 B1 4/2002 Bowling et al.
6,452,789 B1 9/2002 Pallotti et al.
6,489,563 B1 12/2002 Zhao et al.
6,535,367 B1 3/2003 Carpenter
6,538,903 B1 3/2003 Radu et al.
6,574,115 B2 6/2003 Asano et al.
6,575,772 B1 6/2003 Soubh et al.
6,592,401 B1 7/2003 Gardner et al.
6,652,296 B2 11/2003 Kuroda et al.
6,652,318 B1 11/2003 Winings et al.
6,685,501 B1 2/2004 Wu et al.
6,692,262 B1 2/2004 Loveless
6,705,893 B1 3/2004 Ko
6,780,069 B2 8/2004 Scherer
6,797,891 B1 9/2004 Blair et al.
6,824,426 B1 11/2004 Spink, Jr.
6,843,657 B2 1/2005 Driscoll et al.
6,859,854 B2 2/2005 Kwong
6,882,241 B2 4/2005 Abo et al.
6,903,934 B2 6/2005 Lo
6,910,914 B1 6/2005 Spink, Jr.
6,916,183 B2 7/2005 Alger et al.
6,955,565 B2 10/2005 Lloyd
6,969,270 B2 11/2005 Renfro
6,969,280 B2 11/2005 Chien
6,971,887 B1 12/2005 Trobough
7,004,765 B2 2/2006 Hsu
7,004,793 B2 2/2006 Scherer
7,008,234 B1 3/2006 Brown
7,044,772 B2 5/2006 McCreery
7,052,292 B2 * 5/2006 Hsu ..... H01R 9/034 439/607.41
7,056,128 B2 6/2006 Driscoll et al.
7,066,756 B2 * 6/2006 Lange ..... H01R 12/7017 439/289
7,070,446 B2 7/2006 Henry
7,108,522 B2 9/2006 Verelst et al.
7,148,428 B2 12/2006 Meier et al.
7,168,961 B2 1/2007 Hsieh
7,175,446 B2 2/2007 Bright
7,192,300 B2 * 3/2007 Hashiguchi ..... H01R 9/0524 439/497

(56) References Cited

U.S. PATENT DOCUMENTS 7,214,097 B1 5/2007 Hsu et al.
7,223,915 B2 5/2007 Hackman
7,234,944 B2 6/2007 Nordin
7,244,137 B2 7/2007 Renfro et al.
7,280,372 B2 10/2007 Grundy et al.
7,307,293 B2 12/2007 Fjelstad et al.
7,331,816 B2 2/2008 Krohn
7,384,275 B2 6/2008 Ngo
7,394,665 B2 7/2008 Hamasaki et al.
7,402,048 B2 7/2008 Meier et al.
7,431,608 B2 10/2008 Sakaguchi et al.
7,445,471 B1 11/2008 Scherer et al.
7,462,924 B2 12/2008 Shuey
7,489,514 B2 2/2009 Hamasaki
7,534,142 B2 5/2009 Avery
7,540,773 B2 6/2009 Ko
7,549,897 B2 6/2009 Fedder
7,621,779 B2 11/2009 Laurx et al.
7,637,767 B2 12/2009 Davis
7,654,831 B1 2/2010 Wu
7,658,654 B2 2/2010 Ohyama
7,690,930 B2 4/2010 Chen et al.
7,719,843 B2 5/2010 Dunham
7,737,360 B2 6/2010 Wiemeyer et al.
7,744,385 B2 * 6/2010 Scherer ..... H01R 13/6471 439/101
7,744,403 B2 6/2010 Barr
7,744,414 B2 6/2010 Scherer et al.
7,748,988 B2 7/2010 Hori
7,771,207 B2 * 8/2010 Hamner ..... H01R 12/7005 439/377
7,789,529 B2 9/2010 Roberts
7,813,146 B1 10/2010 Phan
7,819,675 B2 10/2010 Ko et al.
7,824,197 B1 11/2010 Westman
7,857,629 B2 * 12/2010 Chin ..... H01R 27/00 429/74
7,857,630 B2 12/2010 Hermant et al.
7,862,344 B2 1/2011 Morgan
7,892,019 B2 2/2011 Rao
7,906,730 B2 3/2011 Atkinson et al.
7,931,502 B2 4/2011 Iida
7,985,097 B2 7/2011 Gulla
7,997,933 B2 8/2011 Feldman
8,002,583 B2 8/2011 van Woensel
8,018,733 B2 9/2011 Jia
8,035,973 B2 10/2011 McColloch
8,036,500 B2 10/2011 McColloch
8,089,779 B2 1/2012 Fietz et al.
8,096,813 B2 1/2012 Biggs
8,157,573 B2 4/2012 Tanaka
8,162,675 B2 4/2012 Regnier
8,187,038 B2 5/2012 Kamiya
8,192,222 B2 6/2012 Kameyama
8,226,441 B2 7/2012 Regnier
8,308,491 B2 11/2012 Nichols et al.
8,337,243 B2 12/2012 Elkhatib et al.
8,338,713 B2 12/2012 Fjelstad et al.
8,398,433 B1 3/2013 Yang
8,419,472 B1 4/2013 Swanger
8,435,074 B1 5/2013 Grant
8,439,704 B2 5/2013 Reed
8,449,312 B2 5/2013 Lang
8,449,330 B1 5/2013 Schroll
8,465,302 B2 6/2013 Regnier
8,480,413 B2 7/2013 Minich
8,517,765 B2 8/2013 Schroll
8,535,069 B2 9/2013 Zhang
8,540,525 B2 9/2013 Regnier
8,553,102 B2 10/2013 Yamada
8,575,491 B2 11/2013 Gundel et al.
8,575,529 B2 11/2013 Asahi
8,585,442 B2 11/2013 Tuma et al.
8,588,561 B2 11/2013 Zbinden
8,597,055 B2 12/2013 Regnier
8,651,890 B2 2/2014 Chiarelli
8,672,707 B2 3/2014 Nichols et al.
8,687,350 B2 4/2014 Santos
8,690,604 B2 4/2014 Davis
8,715,003 B2 5/2014 Buck
8,740,644 B2 6/2014 Long
8,747,158 B2 6/2014 Szczesny
8,753,145 B2 6/2014 Lang
8,758,051 B2 6/2014 Nonen et al.
8,764,483 B2 7/2014 Ellison
8,784,122 B2 7/2014 Soubh
8,787,711 B2 7/2014 Zbinden
8,794,991 B2 8/2014 Ngo
8,804,342 B2 8/2014 Behziz et al.
8,814,595 B2 8/2014 Cohen et al.
8,834,190 B2 9/2014 Ngo
8,864,521 B2 10/2014 Atkinson et al.
8,888,533 B2 11/2014 Westman et al.
8,905,767 B2 * 12/2014 Putt, Jr. ..... H01R 13/652 439/101
8,911,255 B2 12/2014 Scherer et al.
8,926,342 B2 1/2015 Vinther
8,926,377 B2 1/2015 Kirk
8,992,236 B2 3/2015 Wittig
8,992,237 B2 3/2015 Regnier
8,992,258 B2 3/2015 Raschilla
9,011,177 B2 4/2015 Lloyd
9,028,281 B2 5/2015 Kirk
9,035,183 B2 5/2015 Kodama et al.
9,040,824 B2 5/2015 Guetig et al.
9,054,432 B2 6/2015 Yang
9,071,001 B2 * 6/2015 Scherer ..... H01R 13/514
9,119,292 B2 8/2015 Gundel
9,136,652 B2 9/2015 Ngo
9,142,921 B2 9/2015 Wanha et al.
9,155,214 B2 10/2015 Ritter
9,160,123 B1 10/2015 Pao
9,160,151 B2 10/2015 Vinther
9,161,463 B2 10/2015 Takamura
9,166,320 B1 10/2015 Herring
9,196,983 B2 * 11/2015 Saur ..... H01R 12/515
9,203,171 B2 12/2015 Yu
9,209,539 B2 12/2015 Herring
9,214,756 B2 12/2015 Nishio
9,214,768 B2 12/2015 Pao
9,232,676 B2 1/2016 Sechrist et al.
9,246,251 B2 1/2016 Regnier
9,277,649 B2 3/2016 Ellison
9,292,055 B2 3/2016 Wu
9,312,618 B2 4/2016 Regnier
9,331,432 B1 5/2016 Phillips
9,350,108 B2 5/2016 Long
9,356,366 B2 5/2016 Moore
9,385,455 B2 7/2016 Regnier
9,391,407 B1 7/2016 Bucher
9,401,563 B2 7/2016 Simpson
9,413,090 B2 8/2016 Nagamine
9,413,097 B2 8/2016 Tamarkin et al.
9,413,112 B2 8/2016 Helster
9,431,773 B2 8/2016 Chen
9,437,981 B2 9/2016 Wu
9,455,538 B2 9/2016 Nishio
9,484,671 B2 11/2016 Zhu
9,484,673 B1 11/2016 Yang
9,490,587 B1 11/2016 Phillips
9,496,655 B1 11/2016 Huang
9,515,429 B2 12/2016 DeGeest
9,525,245 B2 12/2016 Regnier
9,543,688 B2 1/2017 Pao
9,553,381 B2 1/2017 Regnier
9,559,465 B2 1/2017 Phillips
9,565,780 B2 2/2017 Nishio
9,608,388 B2 3/2017 Kondo
9,608,590 B2 3/2017 Hamner
9,627,818 B1 4/2017 Chen
9,660,364 B2 5/2017 Wig et al.
9,666,998 B1 5/2017 deBoer
9,673,570 B2 6/2017 Briant
9,705,258 B2 7/2017 Phillips

(56) References Cited

U.S. PATENT DOCUMENTS 9,812,799 B2* 11/2017 Wittig ..... H01R 12/714
9,846,287 B2 12/2017 Mack
9,985,367 B2 5/2018 Wanha et al.
2001/0016438 A1* 8/2001 Reed ..... H01R 13/6593 439/101
2002/0111067 A1* 8/2002 Sakurai ..... H01R 13/6583 439/607.25
2002/0157865 A1 10/2002 Noda
2002/0180554 A1 12/2002 Clark et al.
2003/0064616 A1* 4/2003 Reed ..... H01R 13/6593 439/108
2003/0073331 A1 4/2003 Peloza
2003/0180006 A1 9/2003 Loh et al.
2003/0222282 A1 12/2003 Fjelstad et al.
2004/0094328 A1 5/2004 Fjelstad et al.
2004/0121633 A1 6/2004 David et al.
2004/0155328 A1 8/2004 Kline
2004/0155734 A1 8/2004 Kosemura et al.
2004/0229510 A1 11/2004 Lloyd
2004/0264894 A1 12/2004 Cooke
2005/0006126 A1 1/2005 Aisenbrey
2005/0051810 A1 3/2005 Funakura
2005/0093127 A1 5/2005 Fjelstad et al.
2005/0130490 A1 6/2005 Rose
2005/0142944 A1 6/2005 Ling
2005/0239339 A1 10/2005 Pepe
2006/0001163 A1 1/2006 Kolbehdari et al.
2006/0035523 A1* 2/2006 Kuroda ..... H01R 23/661 439/607.41
2006/0038287 A1 2/2006 Hamasaki
2006/0079102 A1* 4/2006 DeLessert ..... H01R 12/714 439/65
2006/0079119 A1 4/2006 Wu
2006/0091507 A1 5/2006 Fjelstad et al.
2006/0114016 A1 6/2006 Suzuki
2006/0160399 A1 7/2006 Dawiedczyk
2006/0189212 A1 8/2006 Avery
2006/0194475 A1 8/2006 Miyazaki
2006/0216969 A1 9/2006 Bright
2006/0228922 A1 10/2006 Morriss
2006/0234556 A1 10/2006 Wu
2006/0238991 A1 10/2006 Drako
2006/0282724 A1 12/2006 Roulo
2006/0292898 A1 12/2006 Meredith
2007/0032104 A1 2/2007 Yamada
2007/0141871 A1 6/2007 Scherer
2007/0243741 A1 10/2007 Yang
2008/0024999 A1 1/2008 Huang
2008/0131997 A1 6/2008 Kim et al.
2008/0171476 A1 7/2008 Liu
2008/0186666 A1 8/2008 Wu
2008/0297988 A1 12/2008 Chau
2008/0305689 A1 12/2008 Zhang et al.
2009/0023330 A1 1/2009 Stoner et al.
2009/0166082 A1 7/2009 Liu et al.
2009/0174991 A1 7/2009 Mahdavi
2009/0215309 A1 8/2009 Mongold
2010/0042770 A1 2/2010 Chuang
2010/0068944 A1 3/2010 Scherer
2010/0112850 A1 5/2010 Rao
2010/0159829 A1 6/2010 McCormack
2010/0177489 A1 7/2010 Yagisawa
2010/0190373 A1 7/2010 Yeh
2010/0203768 A1 8/2010 Kondo
2011/0074213 A1 3/2011 Schaffer
2011/0080719 A1 4/2011 Jia
2011/0136387 A1 6/2011 Matsuura
2011/0177699 A1 7/2011 Crofoot et al.
2011/0212633 A1 9/2011 Regnier
2011/0230104 A1 9/2011 Lang
2011/0263156 A1 10/2011 Ko
2011/0300757 A1 12/2011 Regnier
2011/0304966 A1 12/2011 Schrempp
2012/0003848 A1 1/2012 Casher
2012/0033370 A1 2/2012 Reinke et al.
2012/0034820 A1 2/2012 Lang
2012/0225585 A1 9/2012 Lee
2012/0246373 A1 9/2012 Chang
2013/0005178 A1 1/2013 Straka et al.
2013/0012038 A1 1/2013 Kirk
2013/0017715 A1 1/2013 Van Laarhoven
2013/0040482 A1 2/2013 Ngo
2013/0092429 A1 4/2013 Ellison
2013/0148321 A1 6/2013 Liang
2013/0340251 A1 12/2013 Regnier
2014/0041937 A1 2/2014 Lloyd
2014/0073173 A1 3/2014 Yang
2014/0073174 A1 3/2014 Yang
2014/0073181 A1 3/2014 Yang
2014/0111293 A1 4/2014 Madeberg et al.
2014/0217571 A1 8/2014 Ganesan et al.
2014/0242844 A1 8/2014 Wanha
2014/0273551 A1 9/2014 Resendez
2014/0273594 A1* 9/2014 Jones ..... H01B 11/002 439/357
2014/0335736 A1 11/2014 Regnier
2015/0079845 A1* 3/2015 Wanha ..... H01R 13/6477 439/607.41
2015/0090491 A1 4/2015 Dunwoody
2015/0180578 A1 6/2015 Leigh et al.
2015/0207247 A1 7/2015 Chen et al.
2015/0212961 A1 7/2015 Wu
2016/0013596 A1 1/2016 Regnier
2016/0064119 A1 3/2016 Grant
2016/0104956 A1 4/2016 Santos
2016/0181713 A1 6/2016 Peloza
2016/0190720 A1 6/2016 Lindkamp
2016/0190747 A1 6/2016 Regnier
2016/0197423 A1 7/2016 Regnier
2016/0218455 A1 7/2016 Sayre
2016/0233598 A1 8/2016 Wittig
2016/0233615 A1 8/2016 Scholeno
2016/0336692 A1 11/2016 Champion
2016/0380383 A1 12/2016 Lord
2017/0033482 A1 2/2017 Liao
2017/0033509 A1 2/2017 Liao
2017/0077621 A1 3/2017 Liao
2017/0098901 A1 4/2017 Regnier
2017/0110222 A1* 4/2017 Liptak ..... H01B 11/1813
2017/0162960 A1 6/2017 Wanha
2017/0302036 A1 10/2017 Regnier
2017/0365942 A1 12/2017 Regnier
2018/0034175 A1 2/2018 Lloyd

FOREIGN PATENT DOCUMENTS

CN 1647323 A 7/2005
CN 102365907 A 2/2012
DE 3447556 A1 10/1986
JP 02-079571 U 6/1990
JP 04-14372 U1 2/1992
JP 05-059761 U 8/1993
JP 2008-041285 A 2/2008
JP 2008-059857 A 3/2008
JP 2009-043590 A 2/2009
JP 2010-017388 A 1/2010
JP 2010-123274 A 6/2010
JP 2013-016394 A 1/2013
TW M359141 U 6/2009
TW M408835 U 8/2011
TW 201225455 A 6/2012
WO WO 2008-072322 A1 6/2008
WO WO 2012-078434 A2 6/2012
WO WO 2013-006592 A2 1/2013
WO 2016/112379 A1 7/2016

OTHER PUBLICATIONS

Hitachi Cable America Inc., "Direct Attach Cables: OMNIBIT supports 25 Gbit/s interconnections". Retrieved Aug. 10, 2017 from www.hca.hitachi-cable.com/products/hca/catalog/pdfs/direct-attach-cable-assemblies.pdf.

(56) References Cited

OTHER PUBLICATIONS

U.S. Appl. No. 61/714,871, filed Oct. 17, 2012, Wig et al.
Agilent, "Designing Scalable 10G Backplane Interconnect Systems Utilizing Advanced Verification Methodologies," White Paper, Published May 5, 2012, USA.
Amphenol TCS, "Amphenol TCS expands the XCede Platform with 85 Ohm Connectors and High-Speed Cable Solutions," Press Release, Published Feb. 25, 2009, http://www.amphenol.com/about/news-archive/2009/58.
"File:Wrt54gl-layout.jpg-Embedded Xinu", Internet Citation, Sep. 8, 2006. Retrieved from the Internet: URL:http://xinu.mscs.edu/File:Wrt54gl-layout.jpg [retrieved on Sep. 23, 2014].
International Search Report and Written Opinion received for PCT application No. PCT/US2016/012848, dated Apr. 25, 2016, 11 pages.
International Preliminary Report on Patentability received for PCT Application No. PCT/US2016/012848, dated Jul. 20, 2017, 10 pages.
International Search Report and Written Opinion received for PCT application No. PCT/US2016/012862, dated Apr. 21, 2016, 10 pages.
International Preliminary Report on Patentability received for PCT Application No. PCT/US2016/012862, dated Jul. 20, 2017, 10 pages.

* cited by examiner

WIRE TO BOARD CONNECTORS SUITABLE FOR USE IN BYPASS ROUTING ASSEMBLIES

REFERENCE TO RELATED APPLICATIONS

This application claims priority to International Application No. PCT/US2016/012862, filed Jan. 11, 2016, which claims the priority of prior U.S. provisional patent application No. 62/102,045, filed Jan. 11, 2015 entitled "The Molex Channel"; prior U.S. provisional patent application No. 62/102,046, filed Jan. 11, 2015 entitled "The Molex Channel"; prior U.S. provisional patent application No. 62/102,047, filed Jan. 11, 2015 entitled "The Molex Channel"; prior U.S. provisional patent application No. 62/102,048 filed Jan. 11, 2015 entitled "High Speed Data Transmission Channel Between Chip And External Interfaces Bypassing Circuit Boards"; prior U.S. provisional patent application No. 62/156,602, filed May 4, 2015, entitled "Free-Standing Module Port And Bypass Assemblies Using Same", prior U.S. provisional patent application No. 62/156,708, filed May 4, 2015, entitled "Improved Cable-Direct Connector"; prior U.S. provisional patent application No. "62/167,036, filed May 27, 2015 entitled "Wire to Board Connector with Wiping Feature and Bypass Assemblies Incorporating Same"; and, prior U.S. provisional patent application No. 62/182,161, filed Jun. 19, 2015 entitled "Wire to Board Connector with Compliant Contacts and Bypass Assemblies Incorporating Same", all of which are incorporated by reference herein in their entirety.

BACKGROUND OF THE DISCLOSURE

The Present Disclosure relates generally to high speed data transmission systems suitable for use in transmitting high speed signals at low losses from chips, or processors and the like to backplanes, mother boards and other circuit boards, and more particularly to a bypass cable assembly having connectors that provide reliable wiping action during connection to circuit boards contacts of an electronic component.

Electronic devices such as routers, servers, switches and the like need to operate at high data transmission speeds in order to serve the rising need for bandwidth and delivery of streaming audio and video in many end user devices. These devices use signal transmission lines that extend between a primary chip member mounted on a printed circuit board (mother board) of the device, such as an ASIC, FPGA, etc. and connectors mounted to the circuit board. These transmission lines are currently formed as conductive traces on or in the mother board and extend between the chip member(s) to external connectors or circuitry of the device.

Typical circuit boards are usually formed from an inexpensive material known as FR4, which is inexpensive. Although inexpensive, FR4 is known to be lossy in high speed signal transmission lines which transfer data at rates of about 6 Gbps and greater. These losses increase as the speed increases and therefore make FR4 material undesirable for the high speed data transfer applications of about 10 Gbps and greater. This drop off begins at 6 Gbps and increases as the data rate increases. In order to use FR4 as a circuit board material for signal transmission lines, a designer may have to utilize amplifiers and equalizers, which increase the final cost of the device.

The overall length of the signal transmission lines in FR4 circuit boards can exceed threshold lengths, about 10 inches, and may include bends and turns that can create signal reflection and noise problems as well as additional losses. Losses can sometimes be corrected by the use of amplifiers, repeaters and equalizers but these elements also increase the cost of manufacturing the final circuit board. This complicates the layout of the circuit board as additional board space is needed to accommodate these amplifiers and repeaters. In addition, the routing of signal transmission lines in the FR-4 material may require multiple turns. These turns and the transitions which occur at termination points along the signal transmission lines may negatively affect the integrity of the signals transmitted thereby. It then becomes difficult to route transmission line traces in a manner to achieve a consistent impedance and a low signal loss therethrough. Custom materials, such as MEGTRON, are available for circuit board construction which reduces such losses, but the prices of these materials severely increases the cost of the circuit board and, consequently, the electronic devices in which they are used.

Chips are the heart of these routers, switches and other devices. These chips typically include a processor such as an ASIC (application specific integrated circuit) chip and this ASIC chip has a die that is connected to a substrate (its package) by way of conductive solder bumps. The package may include micro-vias or plated through holes which extend through the substrate to solder balls. These solder balls comprise a ball grid array by which the package is attached to the motherboard. The motherboard includes numerous traces formed in it that define transmission lines which include differential signal pairs for the transmission of high speed data signals, ground paths associated with the differential signal pairs, and a variety of low speed transmission lines for power, clock signals and other functions. These traces can include traces routed from the ASIC to the I/O connectors of the device into which external connectors are connected, as well as others that are routed from the ASIC to backplane connectors that permit the device to be connected to an overall system such as a network server or the like or still others that are routed from the ASIC to components and circuitry on the motherboard or another circuit board of the device in which the ASIC is used.

FR4 circuit board materials can handle data transmission speeds of 10 Gbits/sec, but this handling comes with disadvantages. In order to traverse long trace lengths, the power required to transmit these signals also increases. Therefore, designers find it difficult to provide "green" designs for such devices, as low power chips cannot effectively drive signals for such and longer lengths. The higher power needed to drive the signals consumes more electricity and it also generates more heat that must be dissipated. Accordingly, these disadvantages further complicate the use of FR4 as a motherboard material used in electronic devices. Using more expensive, and exotic motherboard materials, such as MEGTRON, to handle the high speed signals at more acceptable losses increases the overall cost of electronic devices. Notwithstanding the low losses experienced with these expensive materials, they still require increased power to transmit their signals and incurred, and the turns and crossovers required in the design of lengthy board traces create areas of signal reflection and potential increased noise.

It therefore becomes difficult to adequately design signal transmission lines in circuit boards and backplanes to meet the crosstalk and loss requirements needed for high speed applications. Although it is desirable to use economical board materials such as FR4, the performance of FR4 falls off dramatically as the data transmission rate approaches 10 Gbps, driving designers to use more expensive board materials and increasing the overall cost of the device in which the circuit board is used. Accordingly, the Present Disclosure is therefore directed to bypass cable assemblies with suitable point-to-point electrical interconnects that cooperatively define high speed transmission lines for transmitting data signals, at 10 Gbps and greater, and which assemblies have low loss characteristics.

SUMMARY OF THE PRESENT DISCLOSURE

Accordingly, there are provided herein, improved high speed bypass assemblies which utilize cables, rather than circuit boards, to define signal transmission lines which are useful for high speed data applications at 10 Gbps and above and with low loss characteristics.

In accordance with the Present Disclosure, a bypass cable assembly is used to route high speed data transmission lines between a chip or chip package and backplanes or circuit boards. The bypass cable assemblies include cables which contain signal transmission lines that avoid the disadvantages of circuit board construction, no matter the material of construction, and which provide independent signal paths with a consistent geometry and structure that resists signal loss and maintains impedances at acceptable levels.

In applications of the Present Disclosure, integrated circuits having the form of a chip, such as an ASIC or FPGA, is provided as part of an overall chip package. The chip is mounted to a package substrate by way of conventional solder bumps or the like and may be enclosed within and integrated to the substrate by way of an encapsulating material that overlies the chip and a portion of the substrate. The package substrate has leads extending from the solder bumps to termination areas on the substrate. Cables are used to connect the chip to external interfaces of the device, such as I/O connectors, backplane connectors and circuit board circuitry. These cables are provided with board connectors at their near ends which are connected to the chip package substrate.

The chip package may include a plurality of contacts which are typically disposed on the underside of the package for providing connections from logic, clock, power and low-speed components as well as high speed signal circuits to traces on the motherboard of a device. These contacts may be located on either the top or bottom surfaces of the chip package substrate where they can be easily connected to cables in a manner that maintains the geometry of the cable signal transmission lines. The cables provide signal transmission lines that bypass the traces on the motherboard. Such a structure not only alleviates the loss and noise problems referred to above, but also frees up considerable space (i.e., real estate) on the motherboard, while permitting low cost circuit board materials, such as FR4, to be used for its construction.

Cables utilized for such assemblies are designed for differential signal transmission and preferably are twin-ax style cables that utilize pairs of signal conductor wires encased within dielectric coverings to form a signal wire pair. The wire pairs may include associated drain wires and all three wires may further be enclosed within an outer shield in the form of a conductive wrap, braided shield or the like. The two signal conductors may be encased in a single dielectric covering. The spacing and orientation of the wires that make up each such wire pair can be easily controlled in a manner so that the cable provides a transmission line separate and apart from the circuit board, and which may extend between a chip, chip set, component and a connector location on the circuit board or between two locations on the circuit board. The ordered geometry of the cables as signal transmission lines components is very easy to maintain and with acceptable losses and noise as compared to the difficulties encountered with circuit board signal transmission lines, no matter what the material of construction.

The near (proximal) ends of the wire pairs are terminated to the chip package and the far (distal) ends of the cables are connected to external connector interfaces in the form of connector ports. The near end connection is preferably accomplished utilizing wire-to-board connectors configured to engage circuit boards and their contacts. In these wire-to-board connectors, free ends of the signal wire pairs are terminated directly to termination tails of the connector terminals in a spacing that emulates the ordered geometry of the cable so that crosstalk and other negative factors are kept to a minimum at the connector location. Each connector includes a support that holds the two signal terminals in a desired spacing and further includes associated a ground shield that preferably at least partially encompasses the signal terminals of the connector. The ground shield has ground terminal formed with it.

In this manner, the ground associated with each wire pair may be terminated to the connector ground shield to form a ground path that provides shielding as well as reduction of cross talk by defining a ground plane to which the signal terminals can broadside couple in common mode, while the signal terminals of the connectors edge couple together in differential mode. The termination of the wires of the bypass cable assembly is done in a manner such that to the extent possible, a specific desired geometry of the signal and ground conductors in the cable is maintained through the termination of the cable to the board connector.

The ground shield may include sidewalls that extend near the mating end of the connector to provide a multiple faceted ground plane. The drain wire, or ground, of each signal wire pair is terminated to the connector ground shield and in this manner, each pair of signal terminals is at least partially encompassed by a ground shield that has two ground terminals integrated therewith for mating with the circuit board.

In one embodiment of the present disclosure, a chip package is provided that includes an integrated circuit mounted to a substrate. The chip package substrate has termination areas to which first (or near) ends of twin-ax bypass cables are terminated. The lengths of the cables may vary, but are at least long enough for some of the bypass cables to be easily and reliably terminated to a first and second external connector interfaces which may include either a single or multiple I/O style and backplane style connectors or the like. The connectors are preferably mounted to faces of the device to permits external connectors, such as plug connectors to be mated therewith. The bypass cable assembly provides a means for the device to be utilized as a complete interior component of a larger device, such as a server or the like in a data center. At the near end, the bypass cables have board connectors that are configured to connect to contact pads on the chip package substrate.

These board connectors are of the wire-to-board style and are configured so that they may be inserted into a receptacle housing on the chip package substrate. Accordingly, the overall chip package-bypass cable assembly can have a "plug and play" capability inasmuch as the entire assembly can be inserted as a single unit supporting multiple individual signal transmission lines. The chip package may be supported within the housing of the device either solely or by way of standoffs or other similar attachments to a low cost, low speed motherboard. Removing the signal transmission lines off of the motherboard frees up space on the motherboard which can accommodate additional functional components to provide added value and function to the device, while maintaining a cost that is lower than a comparable device that utilizes the motherboard for signal transmission lines. Furthermore, incorporating the signal transmission lines into the bypass cables reduces the amount of power needed to transmit high speed signals through the cables, thereby increasing the "green" value of the bypass assembly and reducing the operating cost of devices that use such bypass assemblies.

In one embodiment, the signal pairs of the bypass cables are terminated to wire-to-board connectors in a manner that permits the contact portions of the connector terminals to directly engage contact pads on circuit boards. These contact portions preferably include curved contact surfaces with arcuate surfaces that are oriented in opposition to contact pads on circuit boards. The contact surfaces extend transversely, or at angles, to the longitudinal axes of their respective connectors. The contact portions preferably have J-shaped configurations when viewed from a side, and free ends of the contact portions extend in opposite directions so that when the connectors are inserted into receptacles, or housings, mounted on circuit boards, the contact portions spread apart from in linear paths on the contact pads to provide a wiping action to facilitate removing surface film, dust and the like and to provide a reliable connection.

In another embodiment, the board connectors may be provided with a compliant member that engages the contact portions of the signal terminals. The receptacles used with these style connectors are mounted to the chip package substrate and have openings that accommodate individual connectors. The receptacles include pressure members such as corresponding press arms that engage corresponding opposing surfaces of the connectors and apply a pressure to the connectors in line with the chip package substrate contacts. The compliant member exerts an additional force to fully develop a desired spring force on the connector terminal contact portions that will result in reliable engagement with the chip package contacts. The openings of the receptacle may include a conductive coating on selected surfaces thereof to engage the ground shields of the wire to board connectors. In this manner, the cable twin-ax wires reliably connect to the chip package contacts.

Furthermore, the wire-to-board connectors of the wire pairs are structured as single connector units, or "chiclets," so that each distinct transmission line of a bypass cable assembly may be individually connected to a desired termination point on either the chip package substrate or the circuit board of a device. The receptacles may be provided with openings arranged in preselected patterns, with each opening accommodating a single connector therein. The receptacle openings may further be provided with inner ledges, or shoulders, that define stop surfaces of the receptacle and which engage corresponding opposing surfaces on the connector. These two engaging stop surfaces serve to maintain a contact pressure on the connector to maintain it in contact with the circuit board. During insertion of one of the connectors described above into a receptacle opening, the contact portions of the signal and ground terminals are spread outwardly along a common mating surface of the circuit board and contact pads disposed thereon. This linear movement occurs in a direction transverse to the longitudinal insertion direction of the connector. In this manner, the bypass cables reliably connect circuits on the chip package to external connector interfaces and/or termination points of the motherboard.

Accordingly, there is provided an improved high speed bypass cable assembly that defines a signal transmission line useful for high speed data applications at 10 Ghps or above and with low loss characteristics.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may be understood by reference to the following Detailed Description, taken in connection with the accompanying Figures, wherein like reference numerals identify like elements, and in which.

DETAILED DESCRIPTION

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
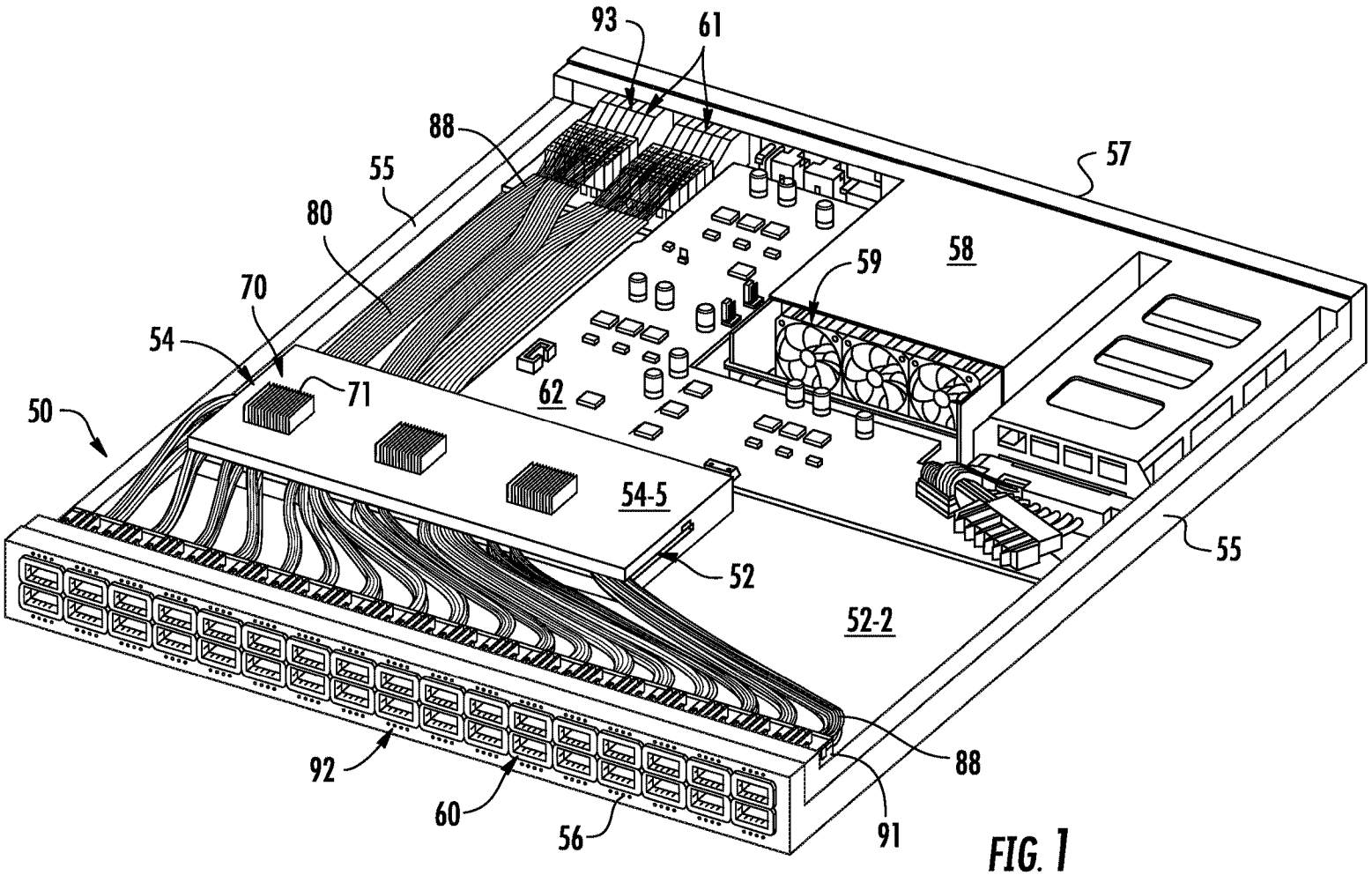
FIG. 1 is a perspective view of an electronic device, such as a switch, router or the like with its top cover removed, and illustrating the general layout of the device components and a bypass cable assembly in place therein.
Figure 2:
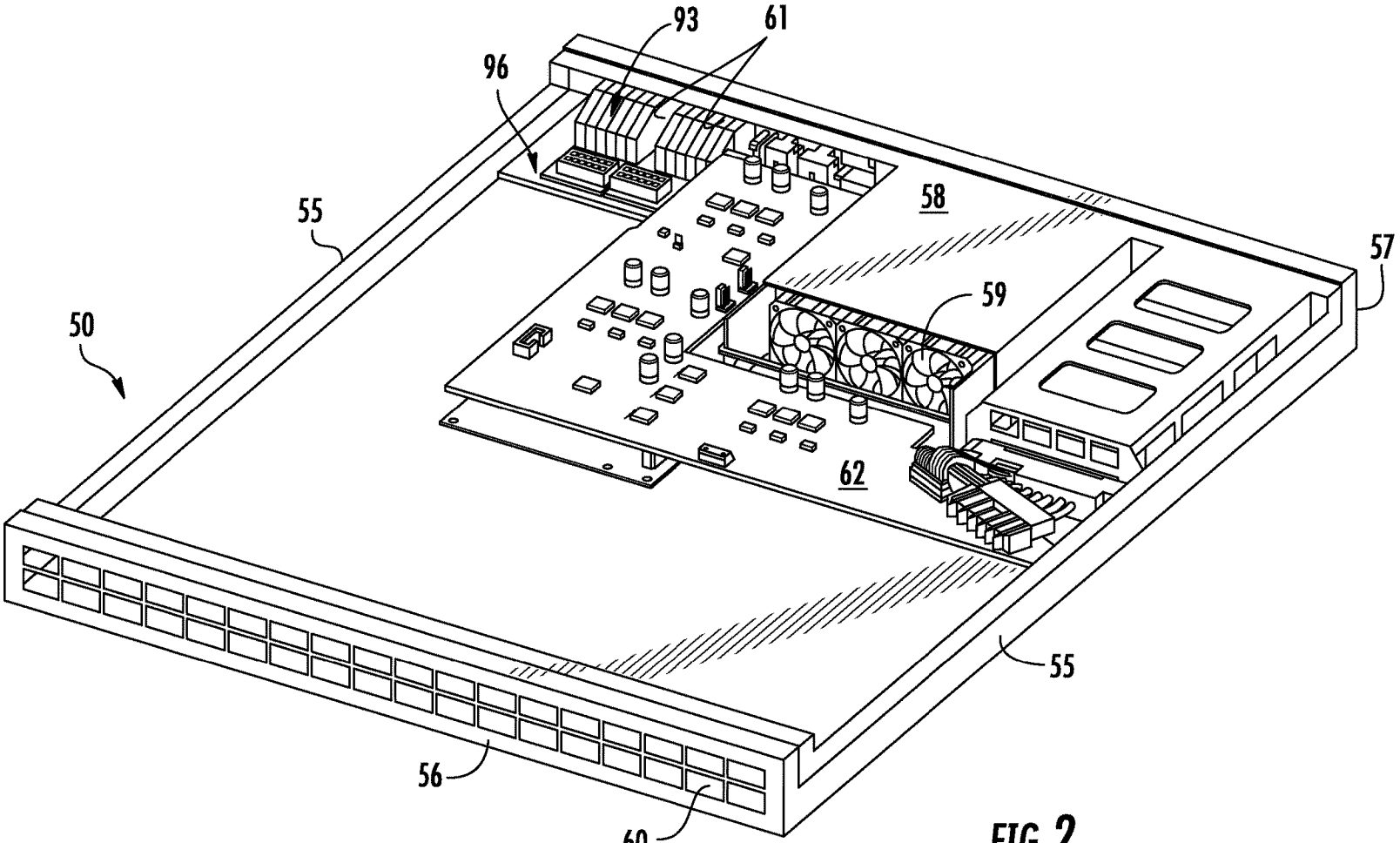
FIG. 2 is the same view as FIG. 1, with the bypass assembly removed from within the device for clarity.

FIG. 1 is a perspective view of an electronic device 50 such as a switch, router, server or the like. The device 50 is governed by one or more processors, or integrated circuits, in the form of chips 52 that may be part of an overall chip package 54. The device 50 has a pair of side walls 55 and front and back walls, 56, 57. Connector ports 60 are provided in the front wall 56 so that opposing mating connectors in the form of cable connectors may be inserted to connect circuits of the device 50 to other devices. Backplane connector ports 61 may be provided in the back wall 57 to accommodate backplane connectors 93 for connecting the device 50 to a larger device, such as a server or the like, including backplanes utilized in such devices. The device 50 includes a power supply 58 and cooling assembly 59 as well as a motherboard 62 with various electronic components thereupon such as capacitors, switches, smaller chips, etc.

Figure 4A:
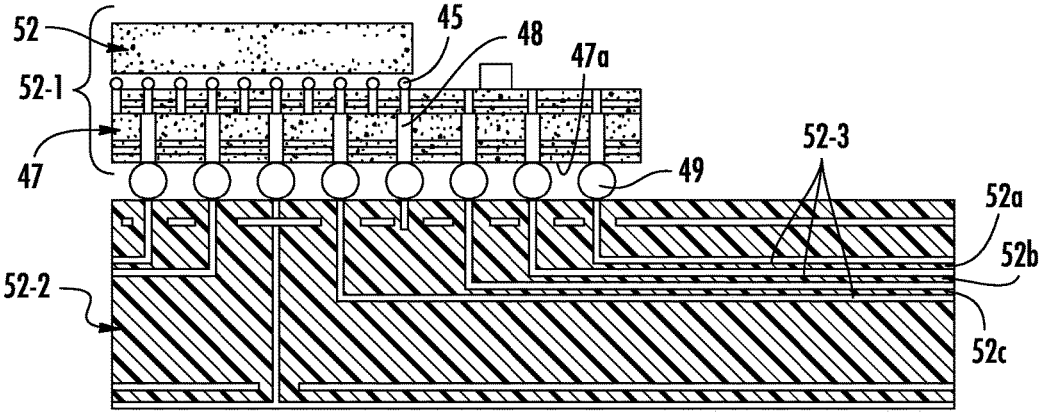
FIG. 4A (PRIOR ART)
FIG. 4A is a schematic cross-sectional view of a known structure traditionally used to connect a chip package to a motherboard in an electronic device such as a router, switch or the like, by way of traces routed through or on the motherboard.

FIG. 4A is a cross-sectional view of a prior art conventional chip package and motherboard assembly that is used in conventional devices. The chip 52 may be an ASIC or any another type of processor or integrated circuit, such as a FPGA and may be one or more separate integrated circuits positioned together. Accordingly, the term chip will be used herein as a generic term for any suitable integrated circuit. As shown in FIG. 4A, the chip 52 has contacts on its underside in the form of solder bumps 45 that connect it to associated contact pads 46 of a supporting substrate 47 of a chip package. The substrate 47 typically includes plated through-holes, micro vias or traces 48 that extend through the body of the substrate 47 to its underside. These elements 48 connect with contacts 49 disposed on the underside 47*a* of the substrate 47 and these contacts 49 typically may take the form of a BGA, PGA or LGA and the like. The chip 52, solder bumps 45, substrate 47 and contacts 49 all cooperatively define a chip package 52-1. The chip package 52-1 can be mated by way of a socket (not shown) to a motherboard 52-2 made of a suitable material, such as FR4, and used in a device. The motherboard 52-2 typically has a plurality of lengthy conductive traces 52-3 that extend from the chip package contacts 49 through the motherboard 52-2 to other connectors, components or the like of the device. For example, a pair of conductive traces 52*a*, 52*b* are required to define differential signal transmission line and a third conductive trace 52*c* provides an associated ground that follows the path of the signal transmission line. Each such signal transmission line is routed through or on the motherboard 52-2 and such routing has certain disadvantages.

FR4 circuit board material becomes increasing lossy and at frequencies above 10 Ghz this starts to become problematic. Additionally, turns, bends and crossovers of these signal transmission line traces 52*a-c* are usually required to route the transmission line from the chip package contacts 49 to connectors or other components mounted on the motherboard 52-2. These directional changes in the traces 52*a-c* can create signal reflection and noise problems as well as additional losses. Losses can sometimes be corrected by the use of amplifiers, repeaters and equalizers but these elements also increase the cost of manufacturing the final circuit board 52-2. This complicates the layout of the circuit hoard 52-2 because additional board space will be needed to accommodate such amplifiers and repeaters and this additional board space may not be available in the intended size of the device. Custom materials for circuit boards are available that reduce such losses, but the prices of these materials severely increase the cost of the circuit hoard and, consequently, the electronic devices in which they are used. Still further, lengthy circuit traces require increased power to drive high speed signals through them and, as such, they hamper efforts by designers to develop "green" (energy-saving) devices.

Figure 4B:
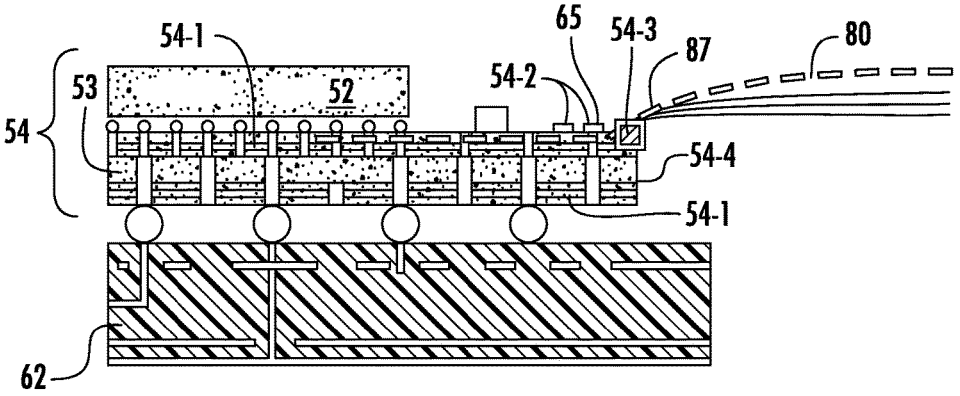
FIG. 4B is a schematic cross-sectional view, similar to FIG. 1A, but illustrating the structure of bypass assemblies of the Present Disclosure and such as that illustrated in FIG. 1, which are used to connect a chip package to connectors or other components of the device if FIG. 1, utilizing cables and consequently eliminating the use of conductive traces as signal transmission lines on the motherboard as illustrated in the device of FIG. 1.

In order to overcome these disadvantages, we have developed bypass cable assemblies that take the signal transmission lines off of the circuit board to eliminate the need to use expensive, custom board materials for circuit boards, as well as largely eliminated the problem of losses in FR4 material. FIG. 4B is a cross sectional view of the chip package 54 and mother board 62 of the device 50 of FIG. 1 which utilizes a bypass cable assembly in accordance with the principles of the present disclosure. The chip 52 may contain high speed, low speed, clock, logic, power and other circuits which are also connected to the substrate 53 of the package 54. Traces 54-1 are formed on or within the substrate 53 and lead to associated contacts 54-2 that may include contact pads or the like, and which are arranged in designated termination areas 54-3 on the chip package substrate 53.

Preferably, these termination areas 54-3 are disposed proximate to, or at edges 54-4 of the chip package 54, as shown in FIG. 4B. The chip package 54 may further include an encapsulant 54-5 that fixes the chip 52 in place within the package 54 as a unitary assembly and which provides a singular, exterior form to the chip package 54 that can be inserted into a device as a single element. In some instances, heat transfer devices, such as heat sinks 70 with upstanding fins 71 may be attached to a surface of the chip as is known in the art in order to dissipate heat generated during operation of the chip 52. These heat transfer devices 70 are mounted to the chips 52 so that the heat-dissipating fins 71 thereof project from the encapsulant 54-5 into the interior air space of the device 50.

Figure 3:
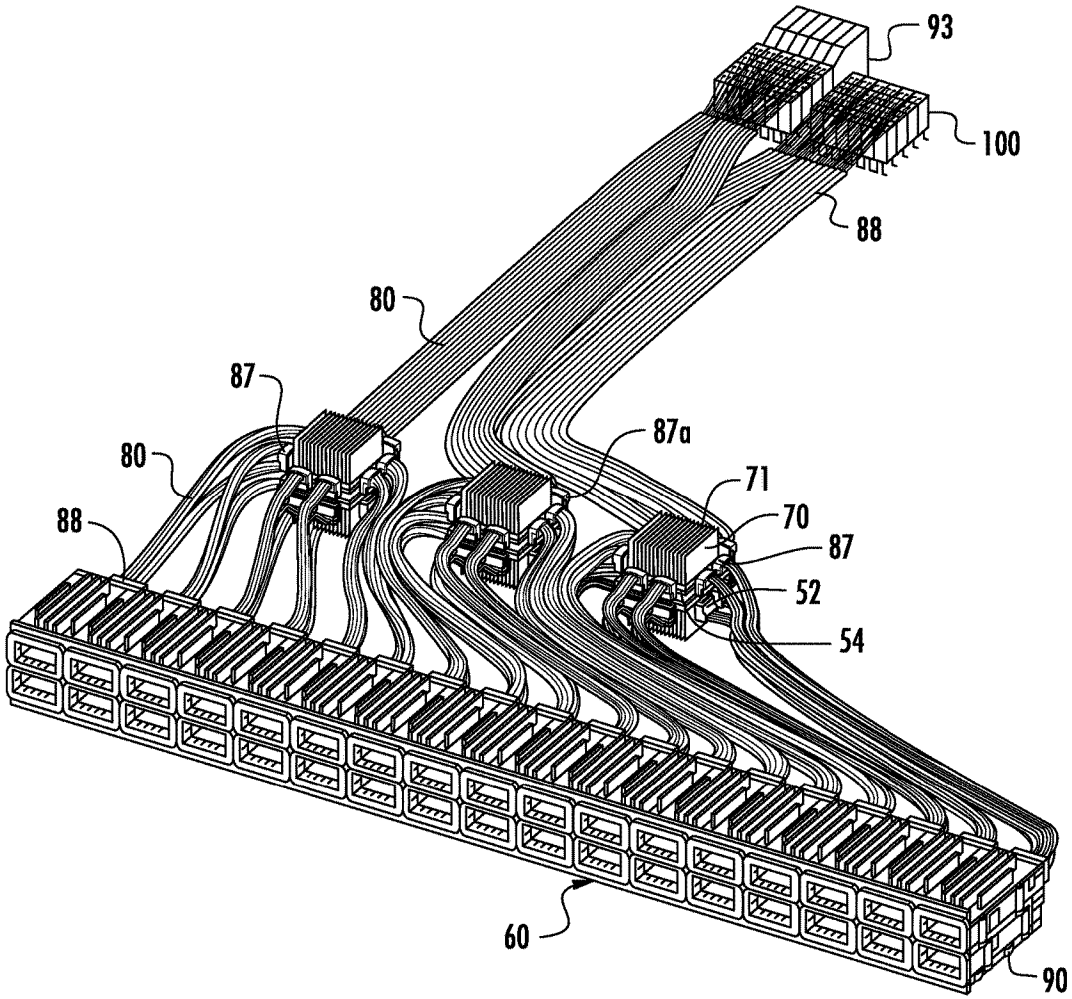
FIG. 3 is a perspective view of the bypass assembly of FIG. 1.
Figure 5:
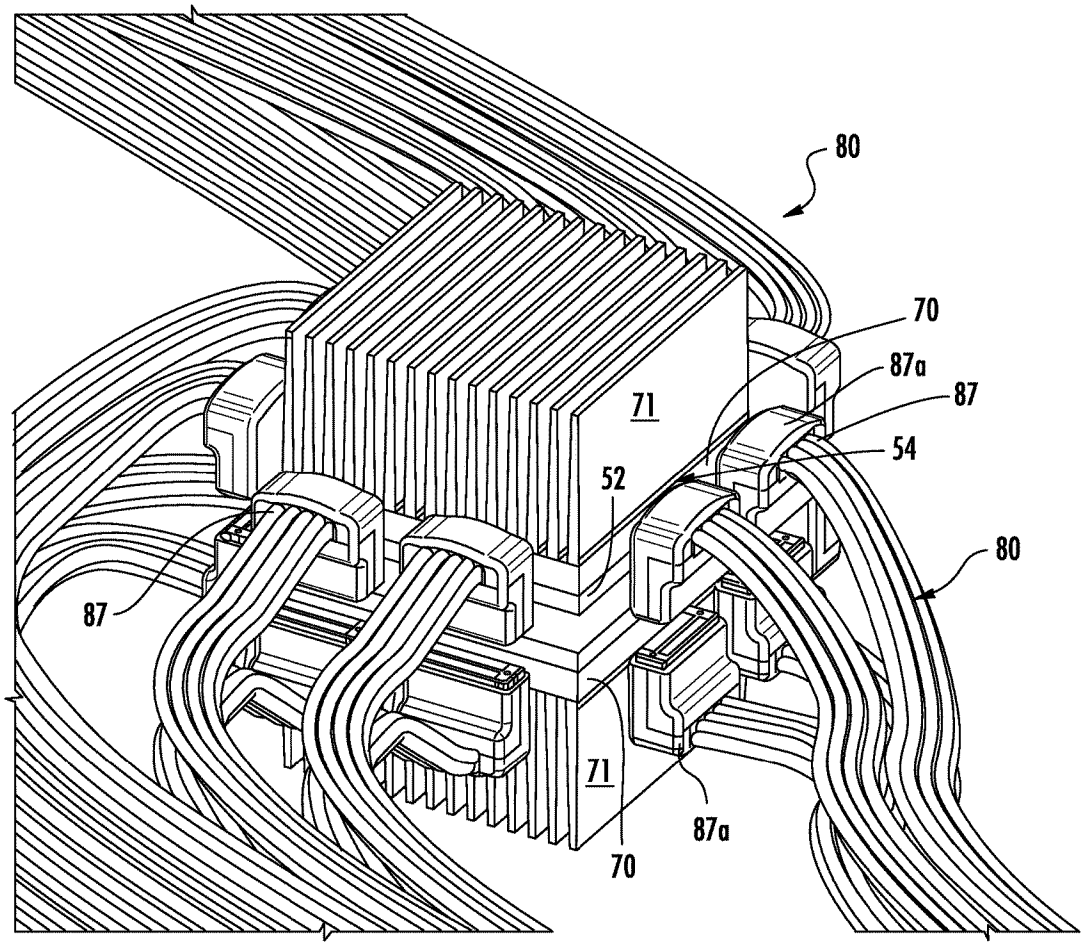
FIG. 5 is an enlarged detail view of the termination area surrounding one of the chips used in the bypass assembly of FIG. 1.

Bypass cables 80 are utilized to connect circuits of the chip package 54 at the cable proximal ends to external connector interfaces and circuits on a circuit board at the cable distal ends. The bypass cables 80 are shown terminated at their proximal ends 87 to the package contact pads 54-2. As shown in FIGS. 3 & 5, the cables proximal ends 87 are generally terminated to plug-style board connectors 87*a*. The cables 80 are preferably of the twin-ax construction with two, interior signal conductors 81 which are depicted as being surrounded by a dielectric covering 82. A drain wire 83 is provided for each cable pair of signal conductors 81 and is disposed within an outer conductive covering 84 and an exterior insulative outer jacket 85. The pairs of signal conductors 81 (and the associated drain wire 83) collectively define respective individual signal transmission lines that lead from circuits on the chip package 54 (and the chip 52 itself) to connectors 90, 93 & 100, or directly to termination points on the motherboard 62 or chip package 54. As noted above, the ordered geometry of the cables bypass 80 will maintain the signal conductors 81 as differential signal transmission pairs in a preselected spacing that controls the impedance for the length of the cable 80. Utilizing the bypass cables 80 as signal transmission lines eliminates the need to lay down high speed signal transmission lines in the form of traces on the motherboard, thereby avoiding high costs of exotic board materials and the losses associated with cheaper board materials such as FR4. The use of flexible bypass cables also reduces the likelihood of signal reflection and helps avoid the need for excessive power consumption and/or for additional board space.

As noted, the bypass cables 80 have opposing proximal ends 87 and distal ends 88 that are respectively connected to the chip package 54 and to distal connectors. The distal connectors may include I/O connectors 90 as illustrated in FIG. 3 at the front of the device and which are housed in the various connector ports 60 of the device 50, or they may include backplane connectors 93 at the rear of the device in ports 61 (FIG. 1) for connecting the host device 50 to another device, or board connectors 100 connected to the motherboard 62 or another circuit board. Connectors 100 are board connectors of the wire-to-board style that connect connector terminal contact portions to contacts on a circuit board or other substrate. It is the latter application, namely as connectors to a chip package, that will be used to explain the structure and some of the advantages of the bypass cable connectors depicted.

The bypass cables 80 define a plurality of individual, high speed signal transmission lines that bypass traces on the motherboard 62 and the aforementioned related disadvantages. The bypass cables 80 are able to maintain the ordered geometry of the signal conductors 81 throughout the length of the cables 80 from the contacts, or termination points 54-2, 54-3, on the chip package 54 to the distal connectors 90, 93 and because this geometry remains relatively ordered, the bypass cables 80 may easily be turned, bent or crossed in their paths without introducing problematic signal reflection or impedance discontinuities into the signal transmission lines. The cables 80 are shown as arranged in first and second sets of cables wherein a first set of bypass cables extends between the chip package 54 and the I/O connectors 90 in the ports 60 in the front wall 56 of the device 50. A second set of bypass cables is shown in FIG. 3 as extending between the chip package 54 and backplane connectors 93 at the rear of the device 50. A third set of bypass cables is also illustrated as extending between the chip package and board connectors 100 which connect them to circuitry on the motherboard 62, also at the rear of the device 50. Naturally, numerous other configurations are possible.

Figure 6:
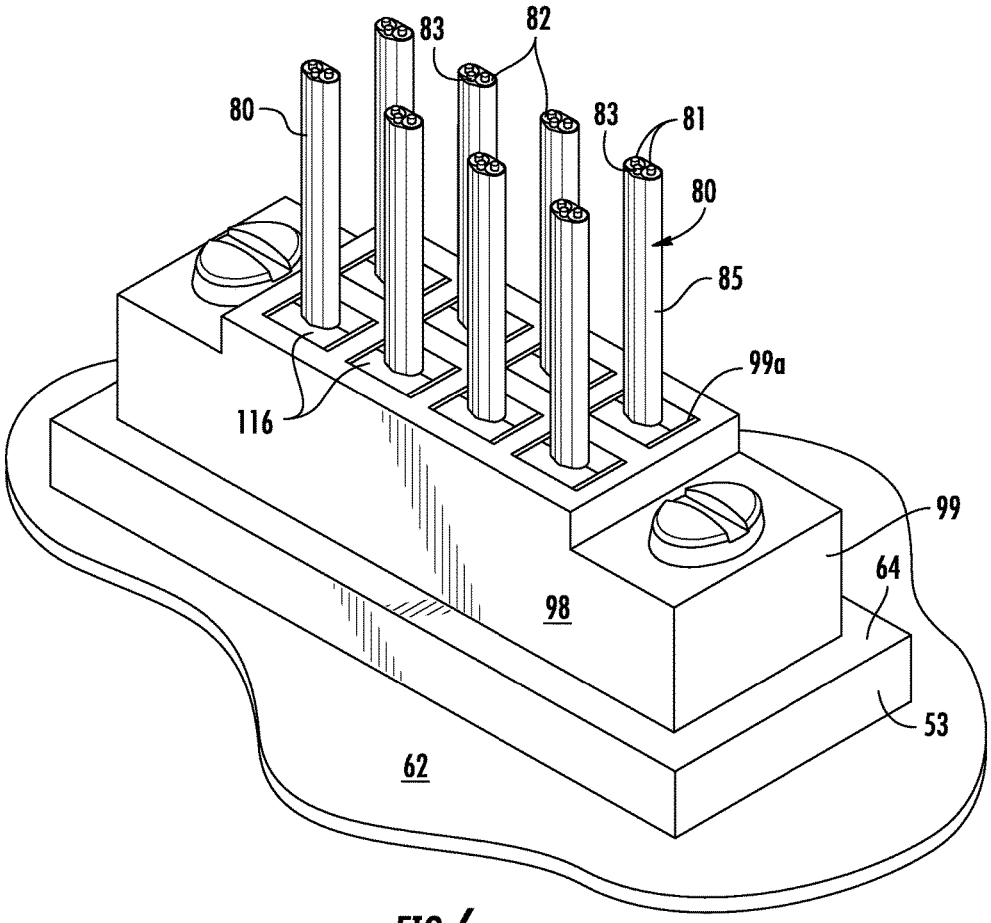
FIG. 6 is a perspective view of one embodiment of a board connector of the present disclosure, mounted to a circuit board, with the proximal ends of the bypass cables and their associated connector housings inserted therein.
Figure 6A:
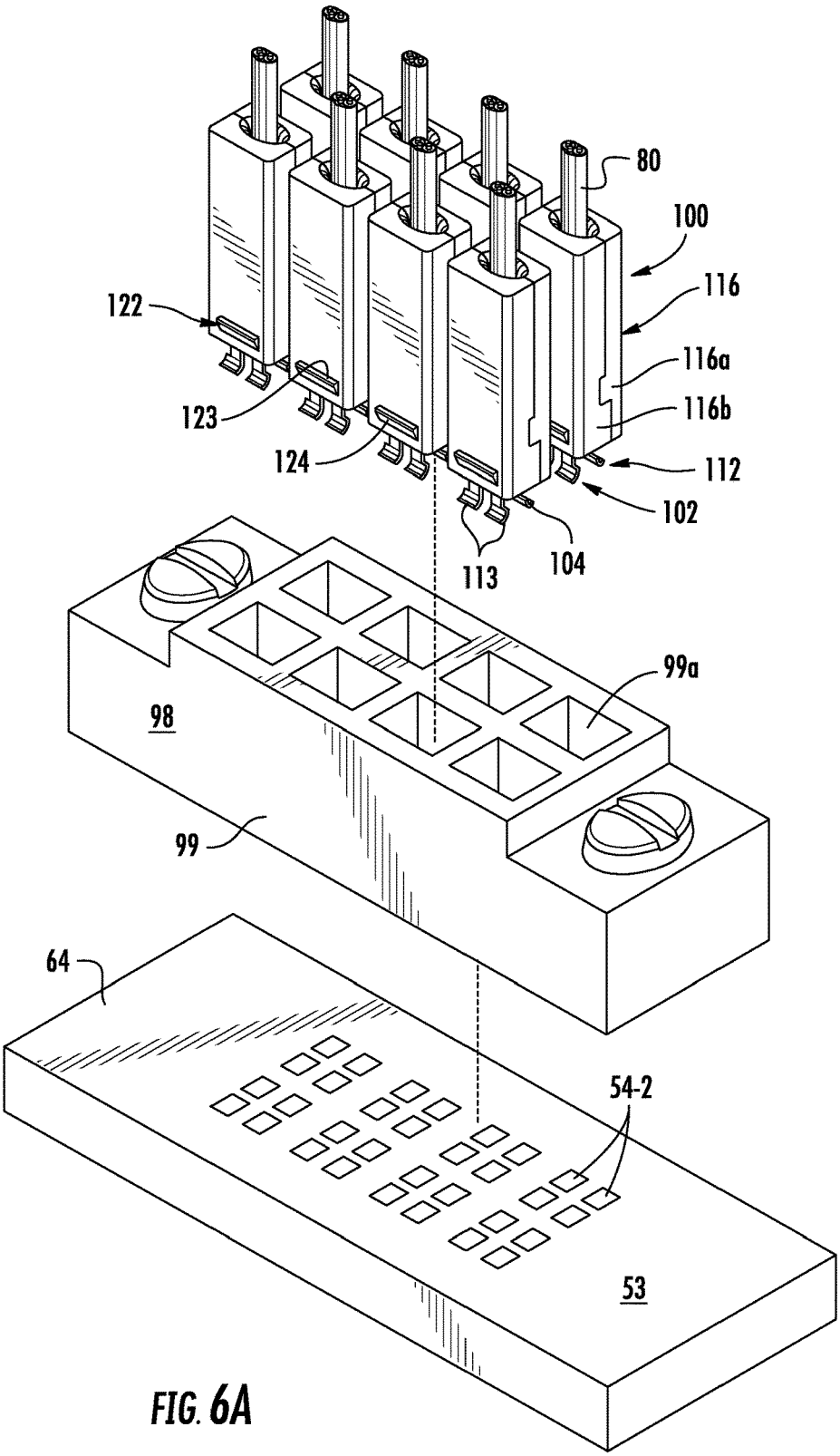
FIG. 6A is an exploded view of the connector structure of FIG. 6.
Figure 6B:
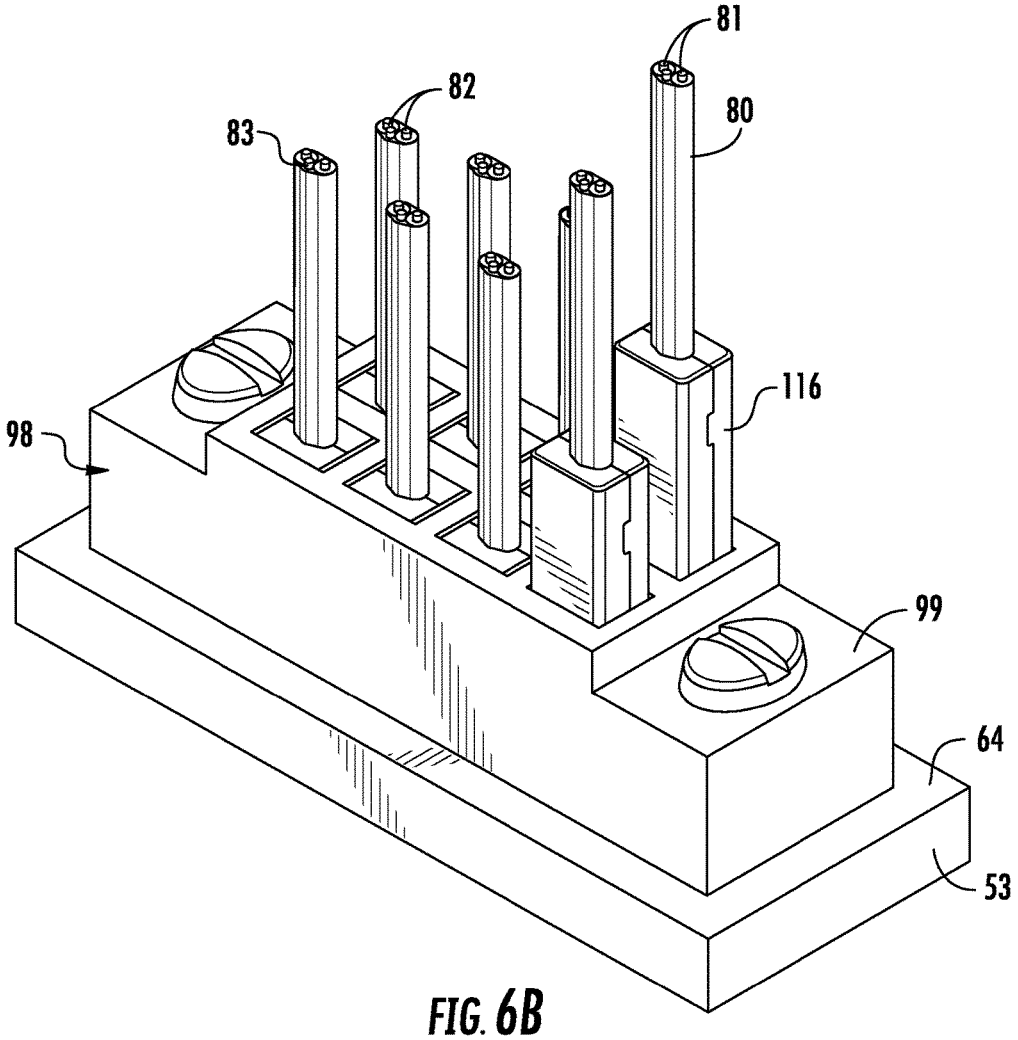
FIG. 6B is the same view as FIG. 6, but with two of the connectors partially moved of place from their corresponding receptacles.

The board connectors 100 of the present disclosure mate with receptacle connectors 98, as illustrated in FIGS. 6 & 6A, which may have bases 99 that are mounted to the motherboard 62 or to the chip package substrate 53. For the most part, such connectors will be mounted to the chip package substrate 53. The receptacle connectors include openings 99*a* formed therein which open to a common mating surface 64 of the chip package substrate 53 that is mounted on a motherboard 62, and each opening 99*a* is shown to receive a single wire to board connector 100 therein. The receptacle connectors 98 may be attached to the substrate and/or motherboard by way of screws, posts or other fasteners.

Figure 6C:
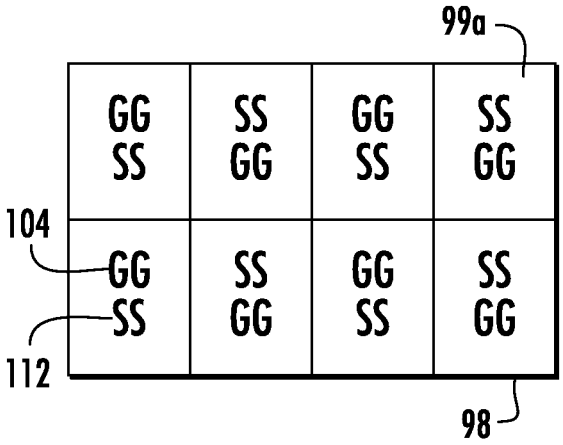
FIG. 6C is a diagram illustrating an embodiment of a signal and ground terminal mating arrangement obtained using the chiclet-style connector assemblies of FIG. 6.
Figure 6D:
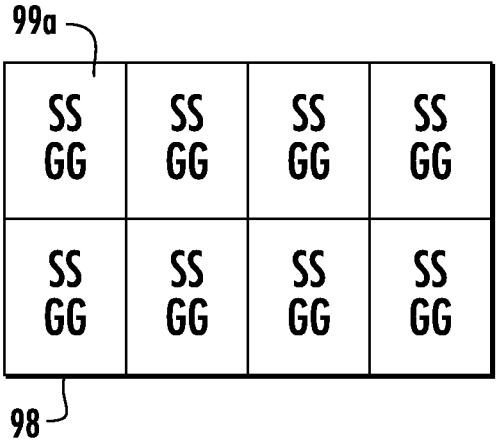
FIG. 6D is another diagram illustrating another embodiment of a signal and ground terminal mating arrangement obtained using the chiclet-style connector assemblies of FIG. 6
Figure 7:
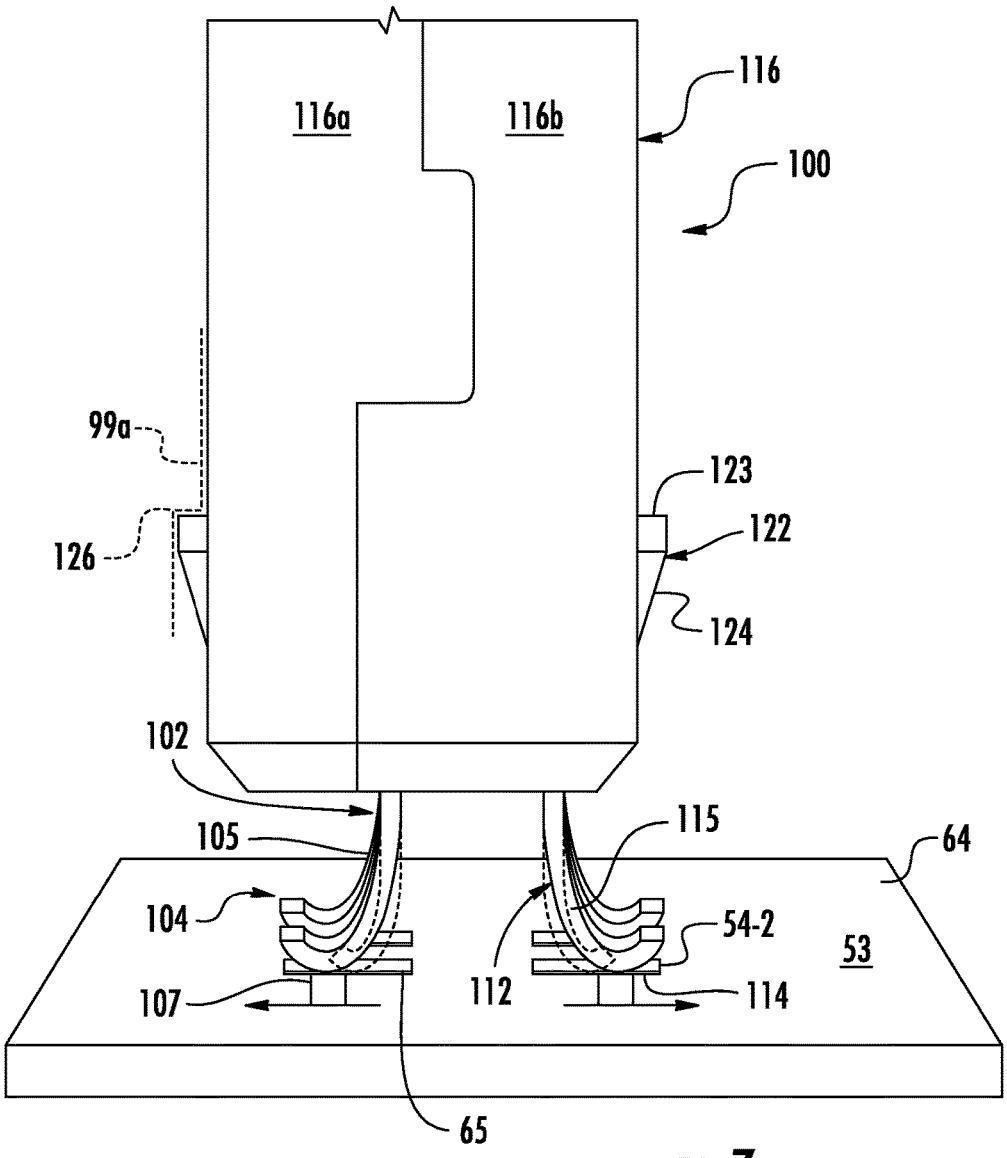
FIG. 7 is a side elevational view of one embodiment of a board connector of the Present Disclosure when it is fully inserted into a connector receptacle and into contact with opposing contacts of a substrate.
Figure 8:
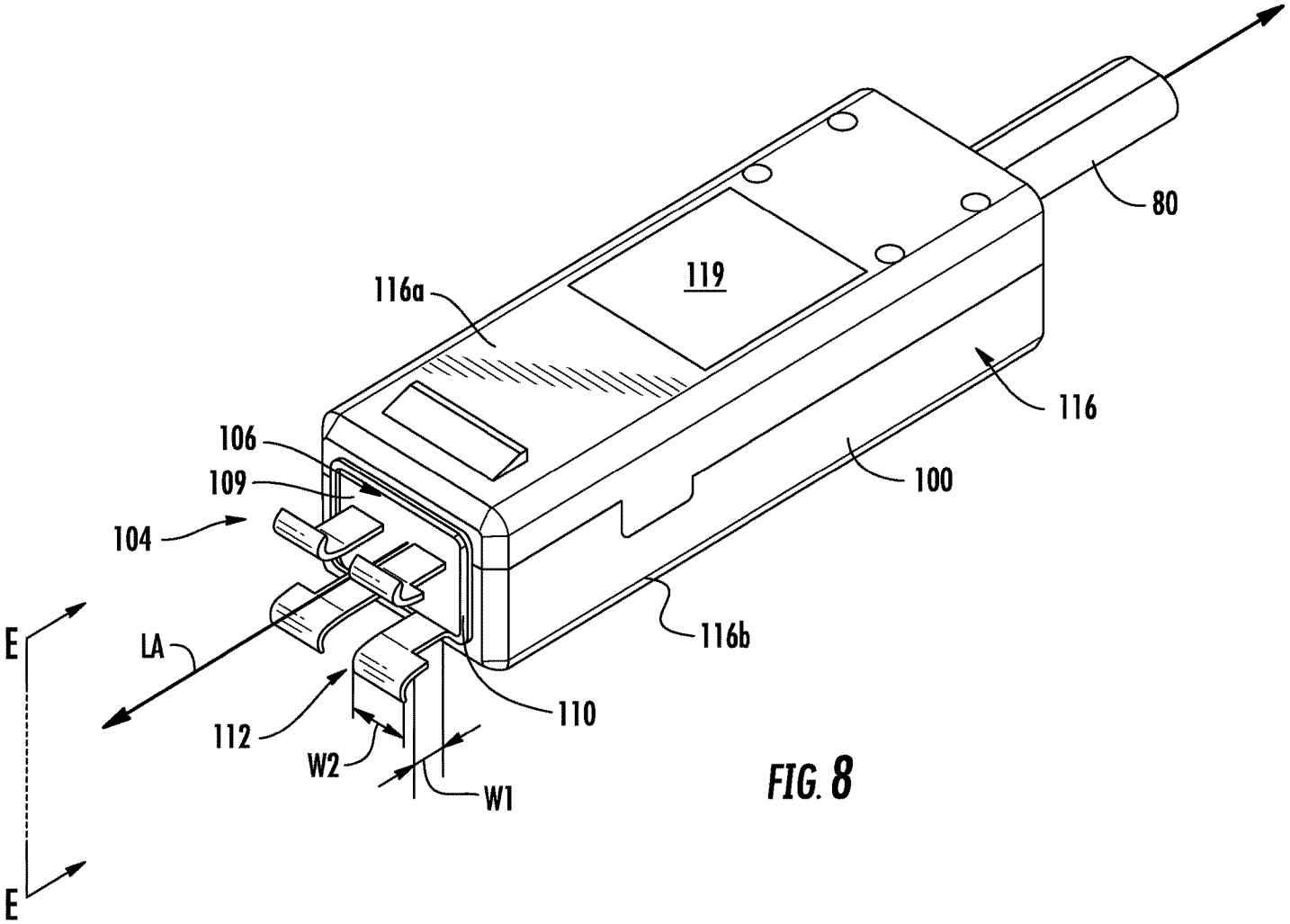
FIG. 8 is a perspective view of the board connector of FIG. 7.
Figure 8A:
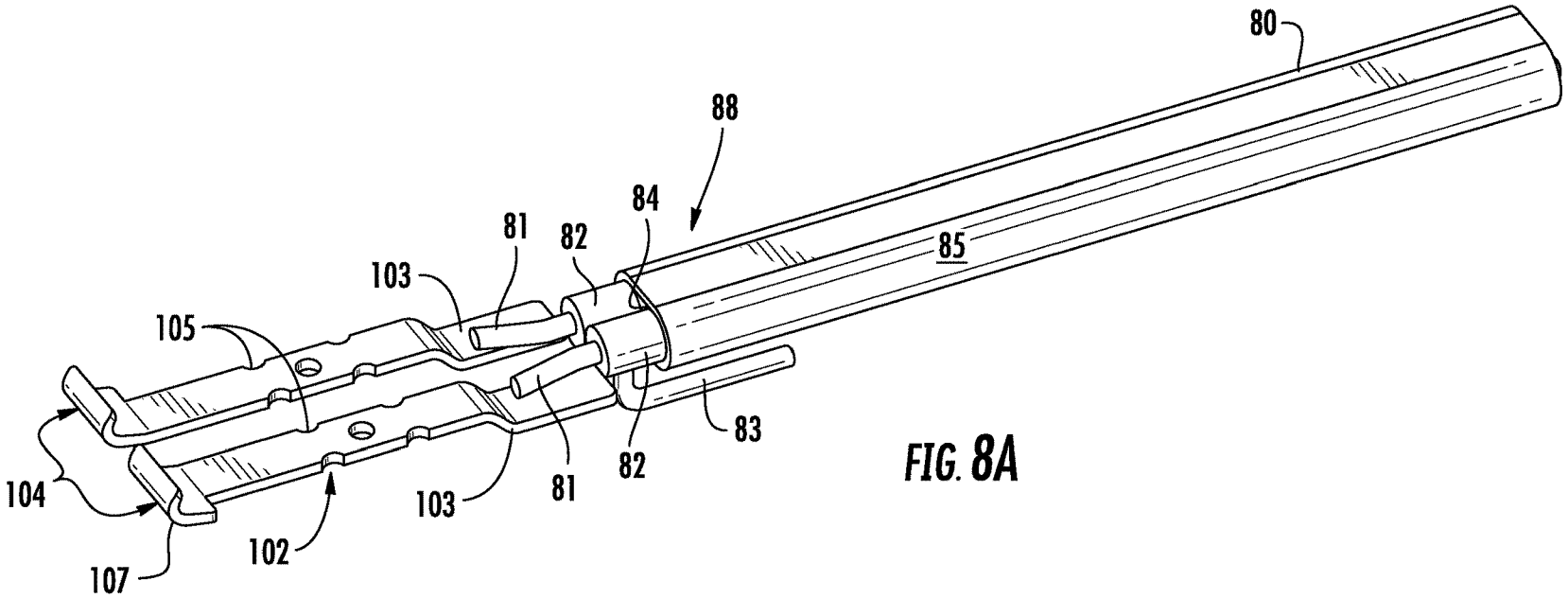
FIG. 8A is a perspective view of the signal terminals of the connector of FIG. 8 terminated to free ends of a bypass cable signal wire pair.
Figure 8B:
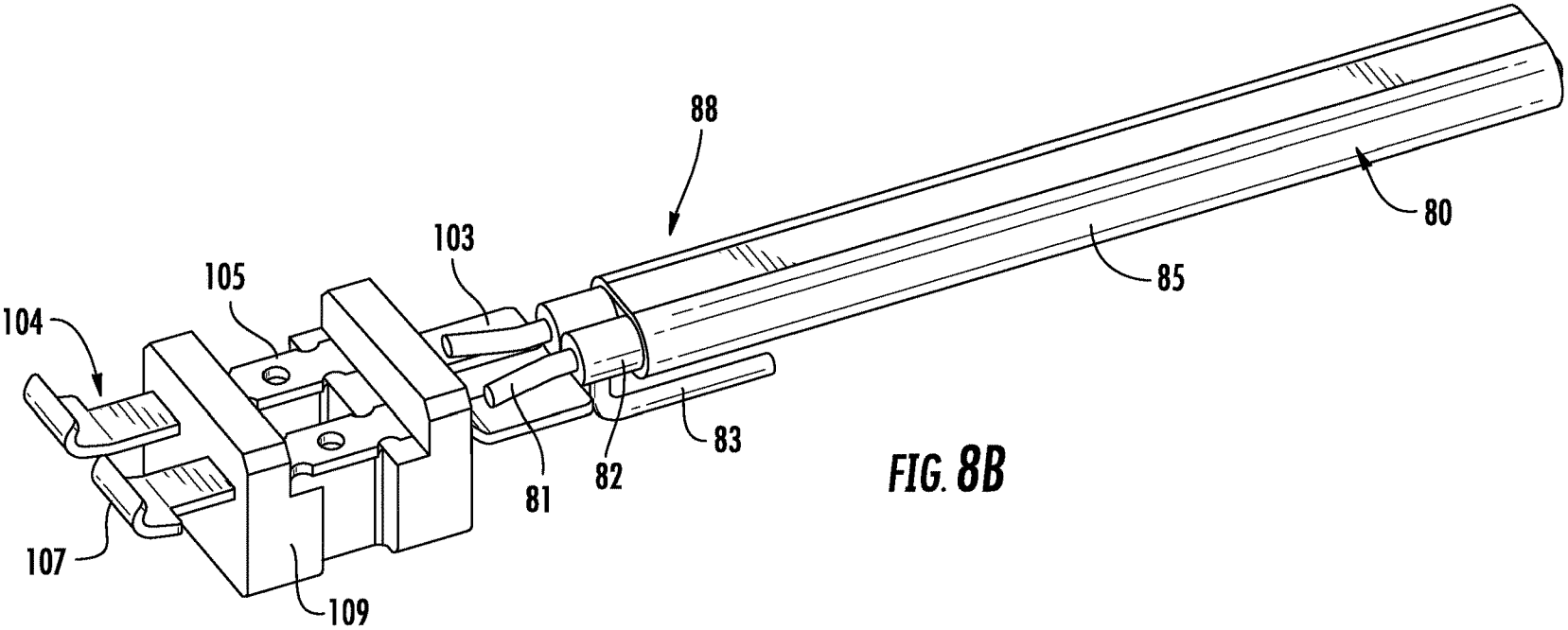
FIG. 8B is the same view as FIG. 8A, but with a spacing block formed about portions of the connector terminals.
Figure 8C:
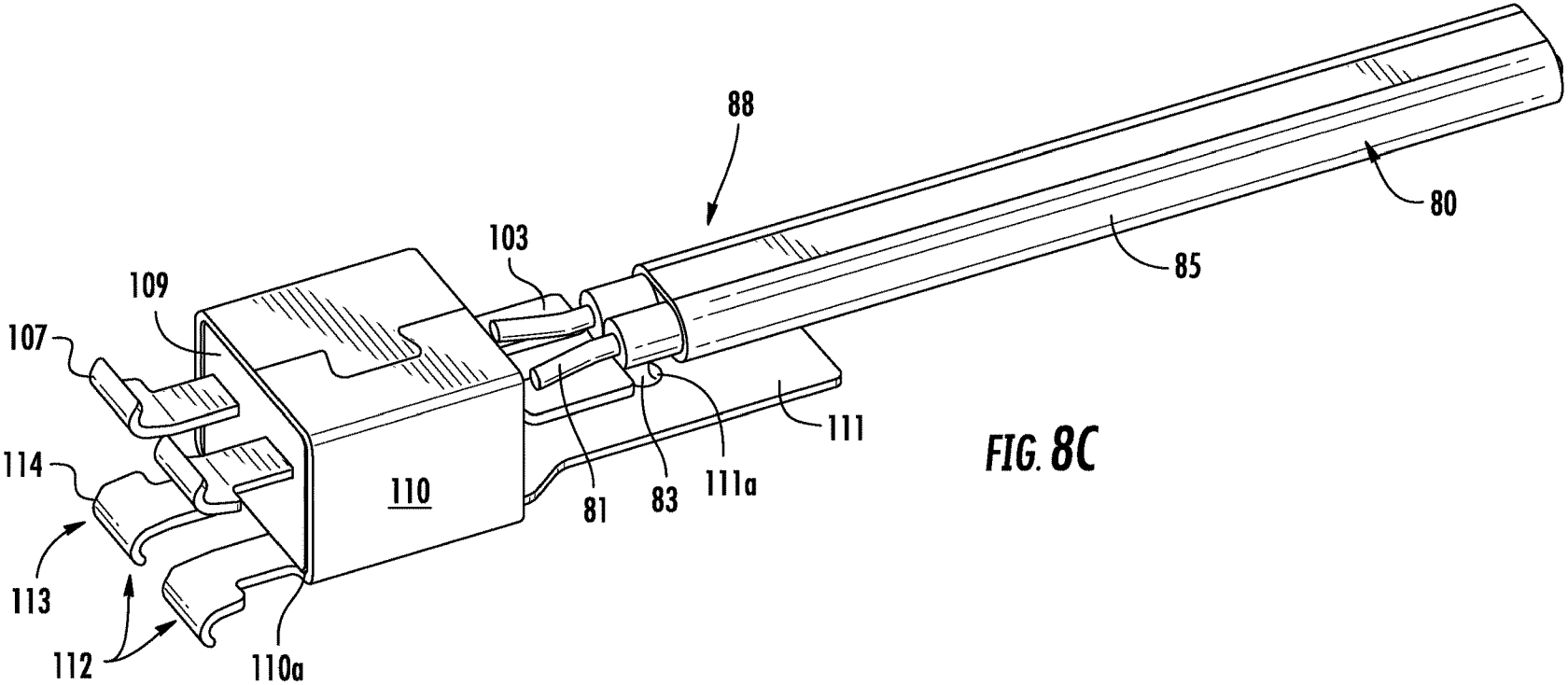
FIG. 8C is the same view as FIG. 8B, but with a connector ground shield in place over the spacing block.
Figure 8D:
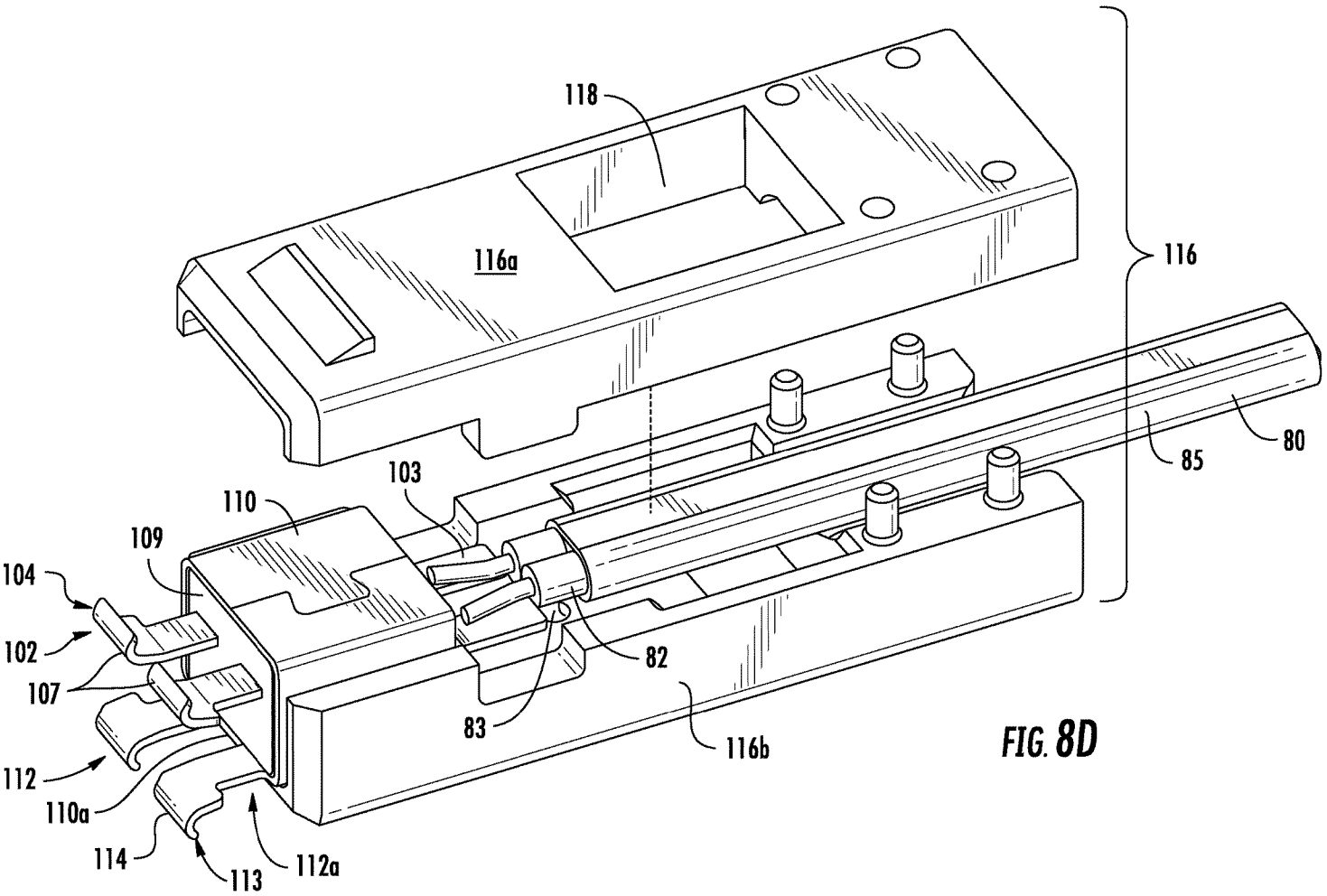
FIG. 8D a perspective view of the connector of FIG. 8, with one of the connector housing halves exploded for clarity.
Figure 8E:
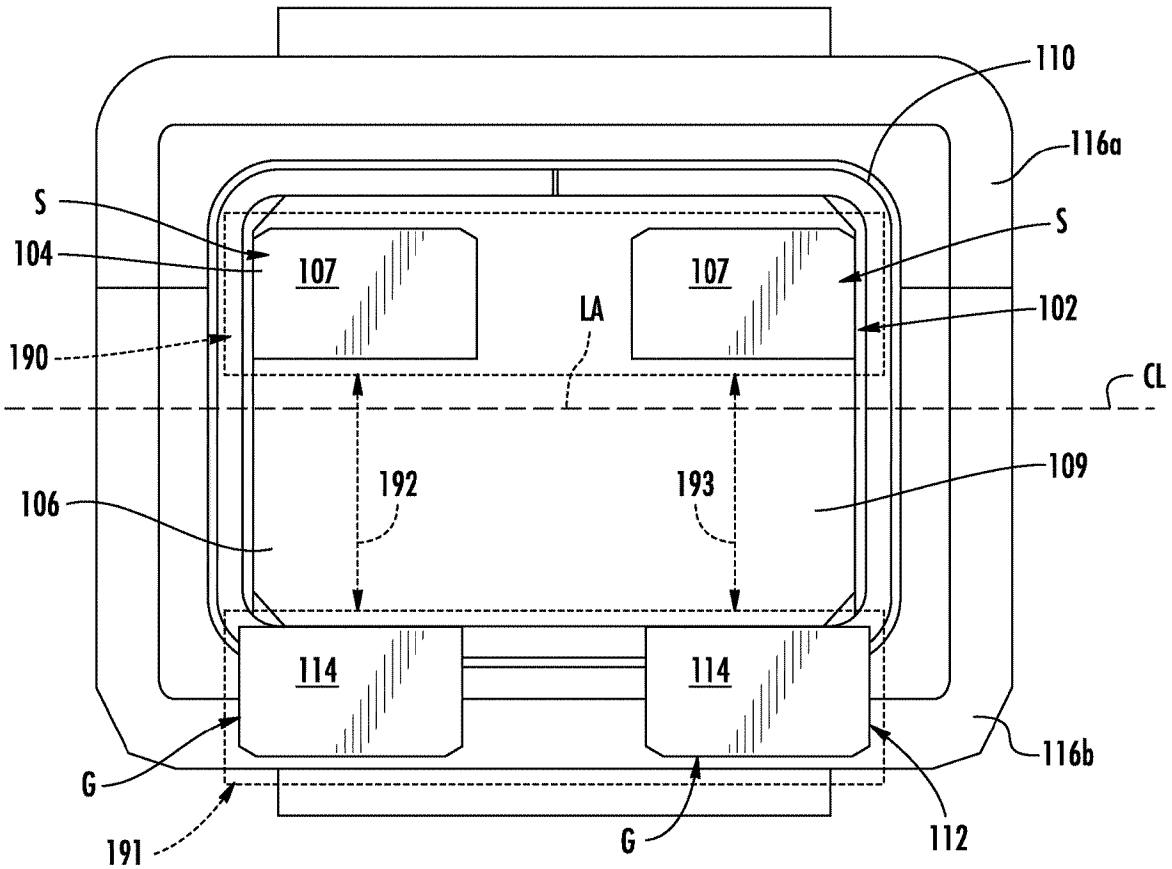
FIG. 8E is a bottom plan view of the mating face of the connector of FIG. 8.

FIGS. 7-8E illustrate one embodiment of a wire to board connector 100 having a pair of spaced-apart signal terminals 102, to which the signal conductors 81 of a bypass cable 80 are terminated to tail portions 103. It should be noted that the depicted configuration, while have certain benefits, is not intended to be limiting. Thus, certain embodiments may include a signal, signal, ground triplet configuration rather than the double ground terminals associated with signal pair. Thus, the pattern shown in FIGS. 6C and 6D could (either an alternating or repeating GG/SS pattern) be modified to show a GSSG pattern or some other desirable pattern such as GSS/G pattern with the bottom G terminal between the signal pair. In other words, it is expected that the particular pattern used will depend on the data rate and the space constraints.

Figure 7A:
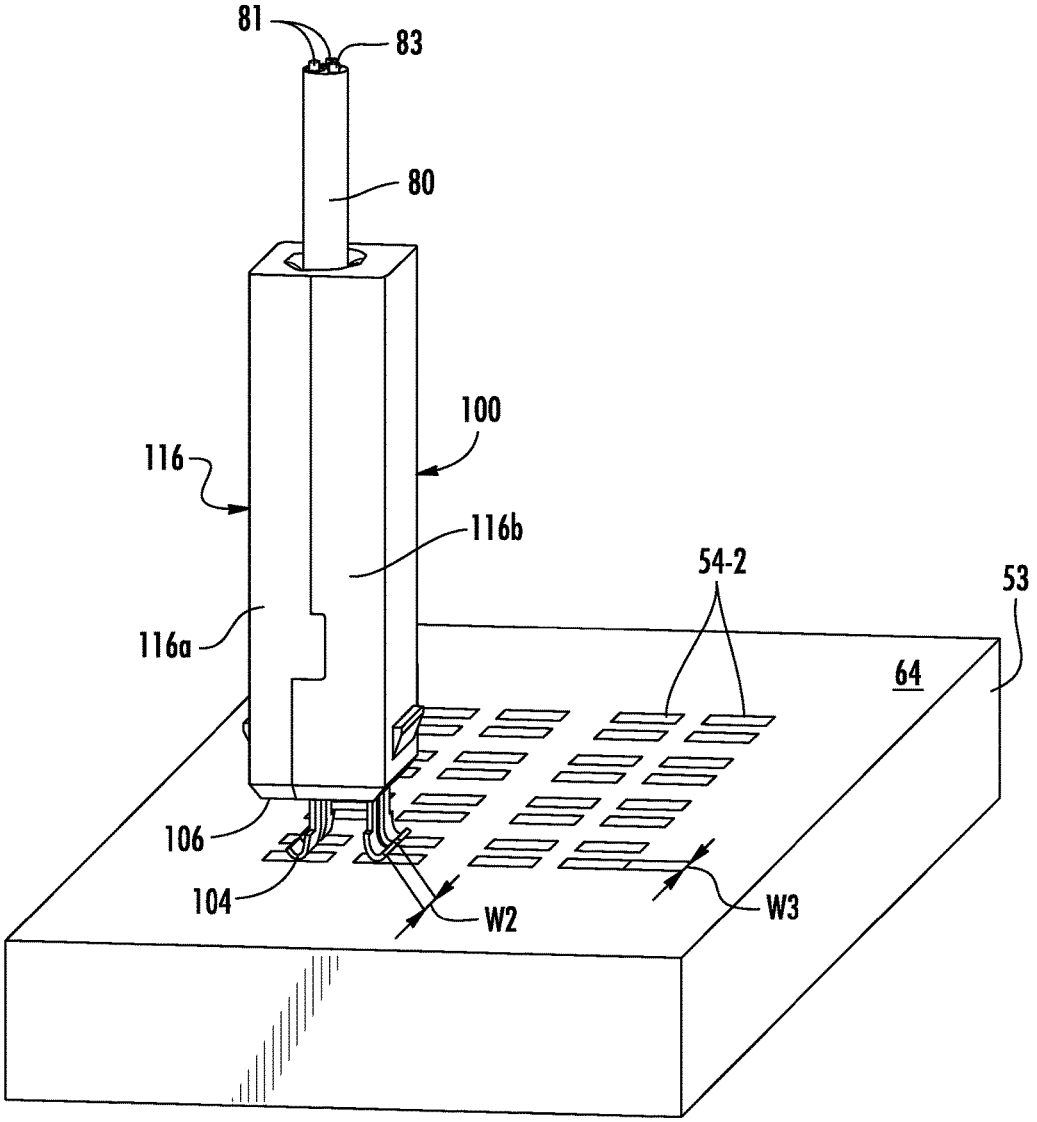
FIG. 7A is an elevational view of the board connector of FIG. 7 partially inserted into a receptacle of a connector housing so that the contact portions of the signal and ground terminals thereof are in initial contact with contacts of a substrate.

As depicted, the signal terminals 102 have contact portions 104 that extend outwardly from a mating end 106 of the connector 100. The signal terminal tail portions 103 and contact portions 104 are interconnected together by intervening signal terminal body portions 105. The signal terminal contact portions 104 can be seen to have generally J-shaped configurations when viewed from the side, as in FIGS. 7-7A & 8. The contact portions 104 include arcuate contact surfaces 107 which are oriented crosswise, or transversely to the longitudinal axes LA of the associated connectors 100 as well as the longitudinal axes of the signal terminals 102. The contact portions 104 have a width W2 that is greater than the width W1 of the terminal body portions 105 (FIG. 8) and preferably this width W2 approximates or is equal to a corresponding width W3 of the chip package or motherboard 54-2, 65. This width difference increases the contact against the contact pads and adds strength to the terminal contact portions.

The contact surfaces 107 have general U-shaped or C-shaped configurations, and they ride upon the chip package substrate contacts 54-2 when the connectors 100 are inserted into their corresponding receptacles 98 and into contact with the mating surface 64 of the chip package substrate 53 by at least a point contact along the width of the contacts 54-2. Although arcuate contact surfaces are shown in the illustrated embodiments, other configurations may work provided that a suitable connection is maintained against the contacts 54-2. In an embodiment other configurations will includes at least a linear point contact with the contacts 54-2. The depicted arcuate surfaces include this type of contact and thereby provide a reliable wiping action. The curved contact surfaces of the connector terminals are also partially compliant and therefore absorb stack-up tolerances that may occur between the receptacle connectors 98 and the chip package substrate 53 to which they are mounted.

The connector 100, as shown in FIG. 8B, is assembled by supporting the signal terminals 102 in a desired spacing with a support block 109 formed from a dielectric material such as LCP which is applied to the terminal body portions 105 as illustrated in FIG. 8B to support the signal terminals 102 during and after assembly. A ground shield 110 (FIG. 8C) is provided that preferably extends, as shown in FIG. 8C, entirely around the support block 109 so that it is maintained at a preselected distance from the signal terminal body portions 105. The ground shield 110 further includes a longitudinal termination tab 111 that extends rearwardly as shown in FIG. 8C and provides a location to which the bypass cable drain wire 83 and conductive wrap 84 may be terminated. As illustrated, the drain 83 wire may be bent upon itself to extend rearwardly of the cable 80 and extend through hole 111*a* of the ground shield termination tab 111. The spacing between the ground shield 110 and its associated termination tab 111 and the signal conductors 81 of the cable 80 and the connector signal terminals 102 may be selected so as to match, or increase or decrease the impedance of the signal transmission line from the signal conductor terminations to the signal terminal contact portions.

The ground shield 110 is also shown as having a pair of spaced-apart ground terminals 112 extending longitudinally therefrom along one side edge 110*a* of the ground shield 110. These ground terminals 112 project past the mating end 106 of the connector 100 and include body portions 112*a*, and J-shaped contact portions 113 with arcuate contact surfaces 114 that extend transversely to the connector axis LA as well as longitudinal axes of the ground terminals 110. As illustrated in FIG. 8E, the signal terminal body and contact portions are aligned together in a pair, as are the ground terminal body contact portions. The signal terminal body and contact portions are further aligned, as a pair, with their corresponding pair of ground terminal body and contact portions. The depicted pair of signal terminals 102 are edge coupled to each other and broadside coupled to the ground shield 110 and ground shield terminals 112 throughout the length of the connector. FIG. 8E further illustrates the arrangement of the signal and ground terminal contact portions. The two signal terminal contact portions 104 are aligned as a pair in a first row 190 and then ground terminal contact portions are aligned as a pair in a second row 191. Single signal and ground terminal contact portions are further aligned together in third and fourth rows, respectively 192 and 193 and these rows can be seen to intersect (or extend transverse to) the first and second rows 190 and 191.

An insulative connector housing 116 having two interengaging halves 116*a*, 116*b* is shown in FIG. 8D as encasing at least the distal end of the bypass cable 80 and portions of the signal terminals 102, especially the termination areas of the cable signal conductors to the signal terminals. The assembled connector housing 116 is shown as generally having four sides and may be provided with one or more openings 118 into which a material such as a potting compound or an LCP may be injected to hold the cable 80 and housing halves 116*a*, 116*b* together as a single unit.

Figure 8F:
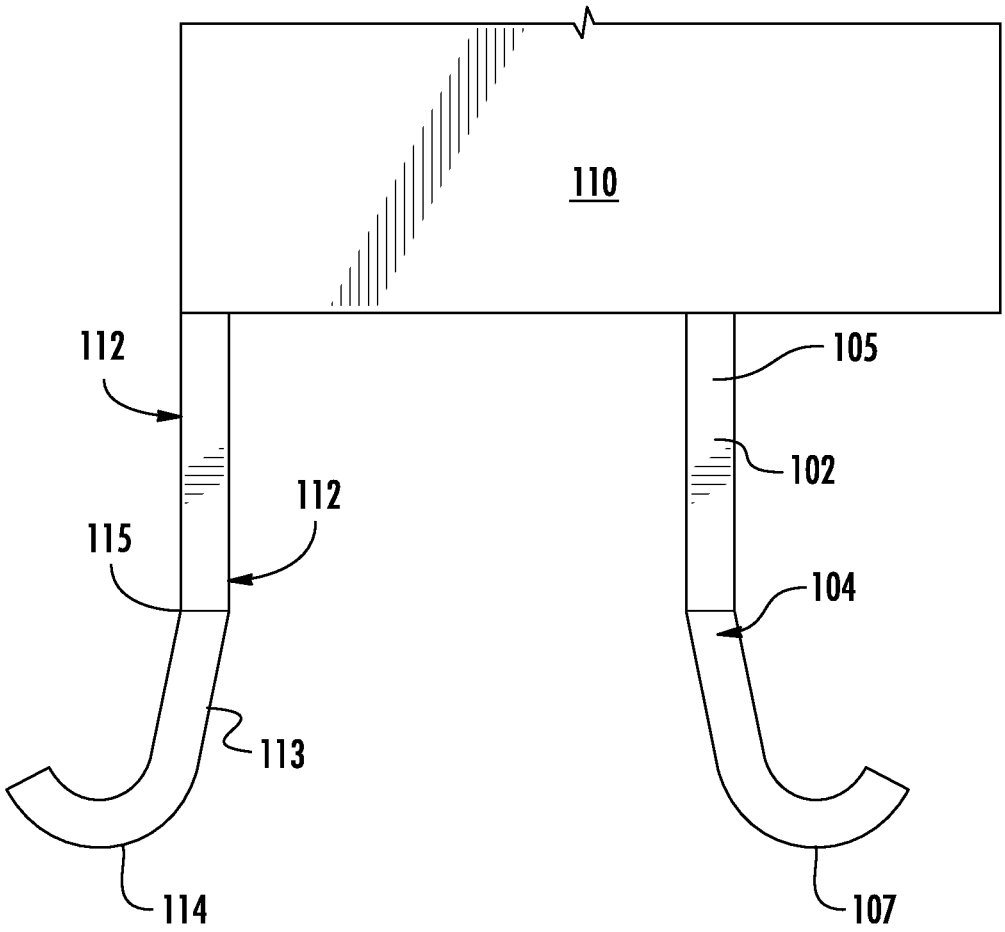
FIG. 8F is an enlarged, side elevational view of the mating end of the connector of FIG. 7 with the connector housing removed for clarity.

As noted earlier, the signal and ground terminal contact portions 104, 113 have general J-shaped configurations. Preferably, this J-shape is in the nature of a compound curve that combines two different radius curves, as is known in the art (FIG. 8F) that meet at an inflection point 115. The inflection points 115 typically are located between the terminal body portions and the terminal contact portions, and predispose the terminal contact portions to flex, or move, in opposite directions along a common linear path as shown by the two arrows in FIG. 7. This structure promotes the desired outwardly, or sideways, movement of the signal and ground contact portions 104, 113 when downward pressure is applied to them. With this structure, as the connector 100 is inserted into the receptacle opening 99*a* and moved into contact with a common, opposing mating surface 64 of the chip package substrate 53, the contact portions will move linearly along the contacts 54-2. Thus, insertion of a connector 100 in the vertical direction (perpendicular to the chip package substrate) promotes movement of the contact portions 104, 113 in horizontal directions. This movement is along a common mating surface 64 of the chip package substrate 53, rather than along opposite mating surfaces as occur in edge card connectors. The contact between the signal and ground terminal contact surfaces 107, 114 and the contacts 65 can be described as a linear point contact that occurs primarily along the base of the J-shape through the width W2 thereof.

Such connectors 100 may be inserted into the openings 99*a* of the receptacle connectors 98 and held in place vertically in pressure engagement against the circuit board mating surface 64. In the embodiment illustrated in FIGS. 7-8F, the connector housing 116 may include a pair of engagement shoulders 122 with planar stop surfaces 123 perpendicular to the longitudinal axis of the connector 100. These stop surfaces 123 will abut and engage complimentary engagement surfaces 126 disposed on the interior of the receptacle openings 99*a*. The engagement shoulders may also include angled lead-in surfaces 124 to facilitate the insertion of the connectors 100 into the receptacles. As illustrated in FIGS. 6C & 6D, the connectors 100 may be inserted into receptacle openings to achieve particular patterns, such as the one shown in FIG. 6D where the signal terminals "S" and ground terminals "G" of each channel are arranged in a common row. Other patterns as possible and one such other pattern is illustrated in FIG. 6C wherein each pair of signal terminals "SS" is flanked on at least two sides by a pair of ground terminals "GG".

Figure 9:
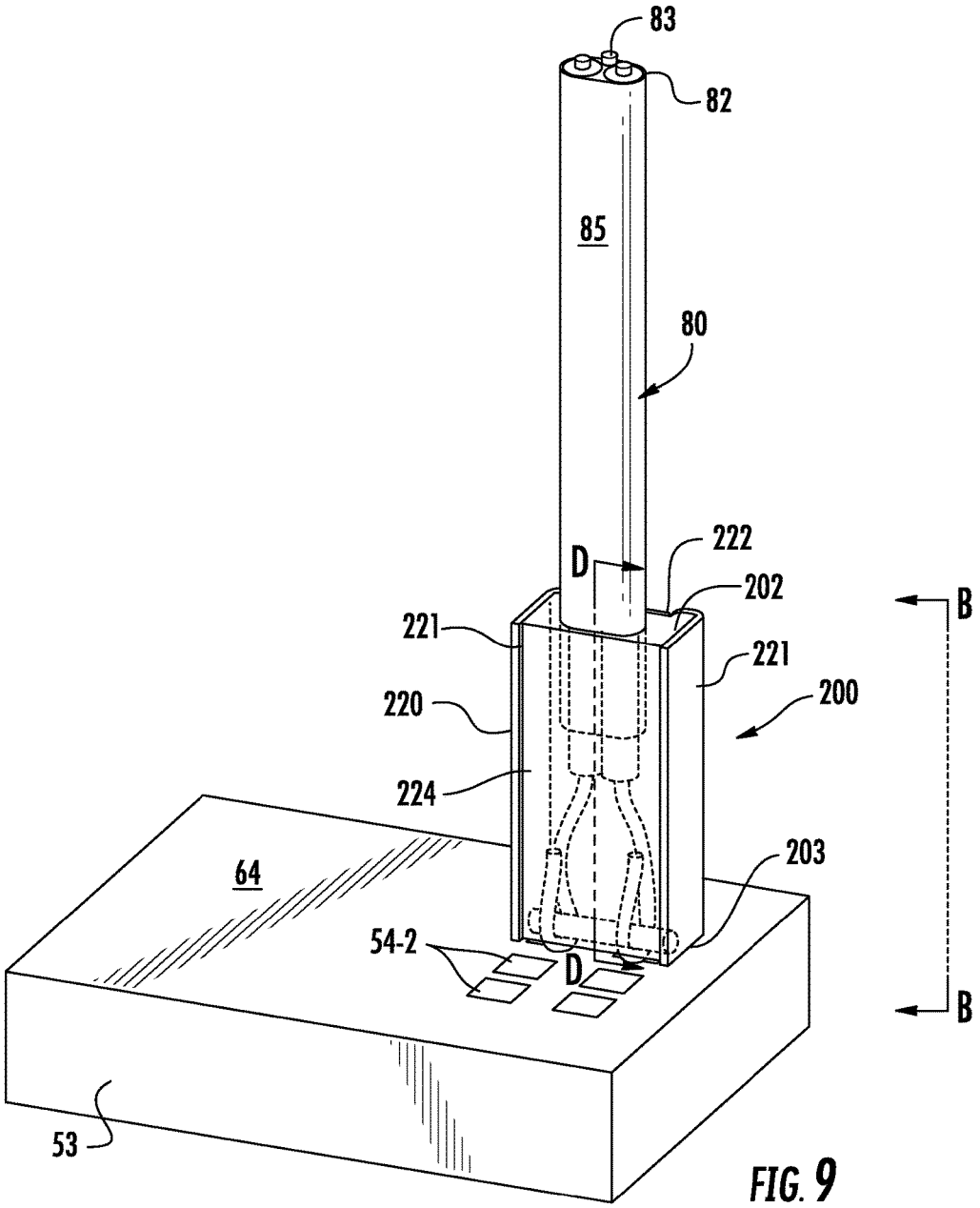
FIG. 9 is a perspective view of another embodiment of a cable bypass board connector that incorporates a compliant member as part of its contact portions.
Figure 9A:
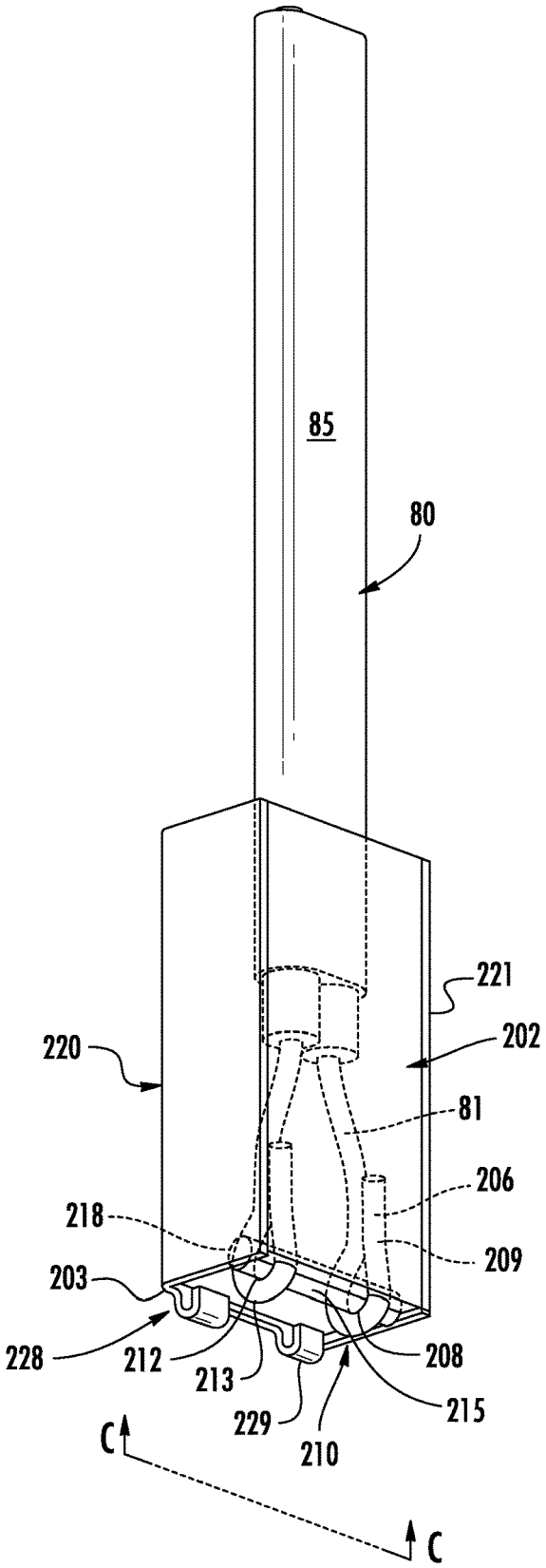
FIG. 9A is a perspective view of the connector of FIG. 9, taken slightly from the bottom and with the signal conductors within the connector body shown in phantom for clarity.
Figure 9B:
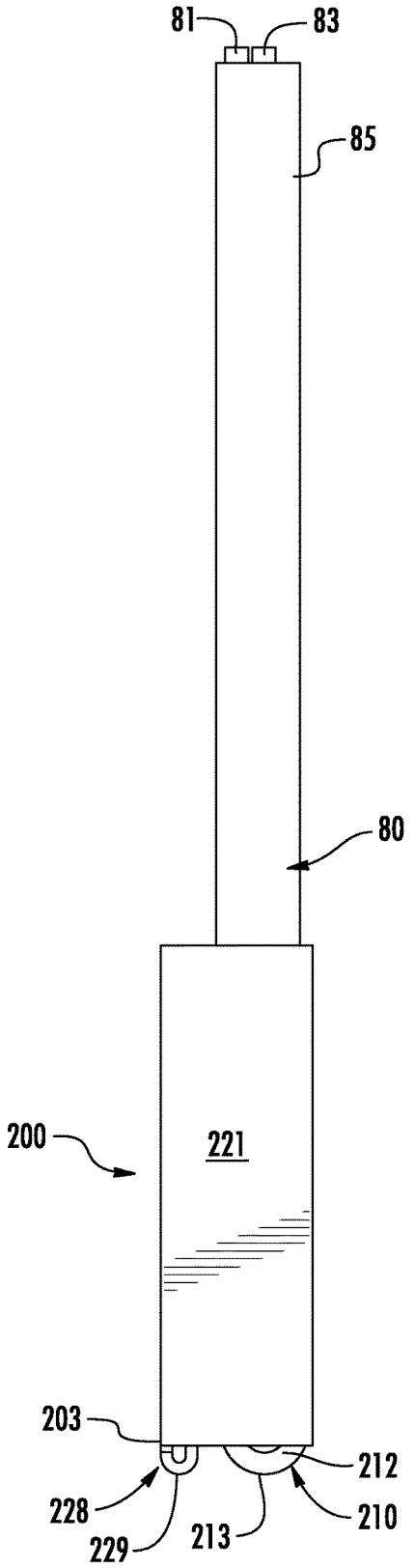
FIG. 9B is a side elevational view of the connector of FIG. 9 taken along lines B-B thereof.
Figure 9C:
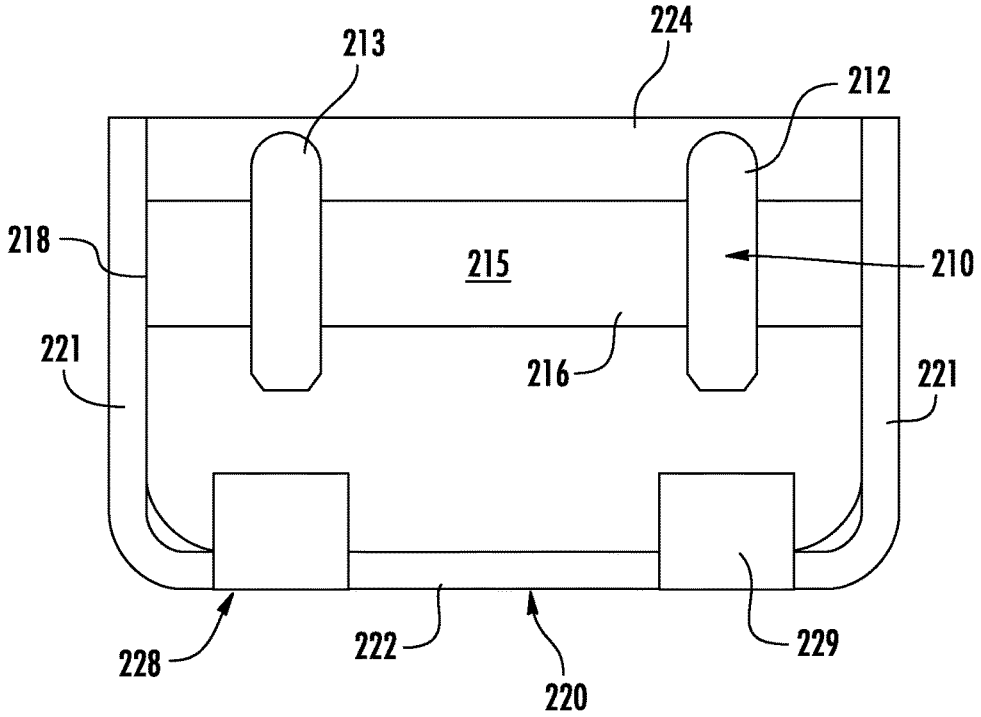
FIG. 9C is a bottom plan view of the connector of FIG. 9A taken along lines C-C thereof.
Figure 9D:
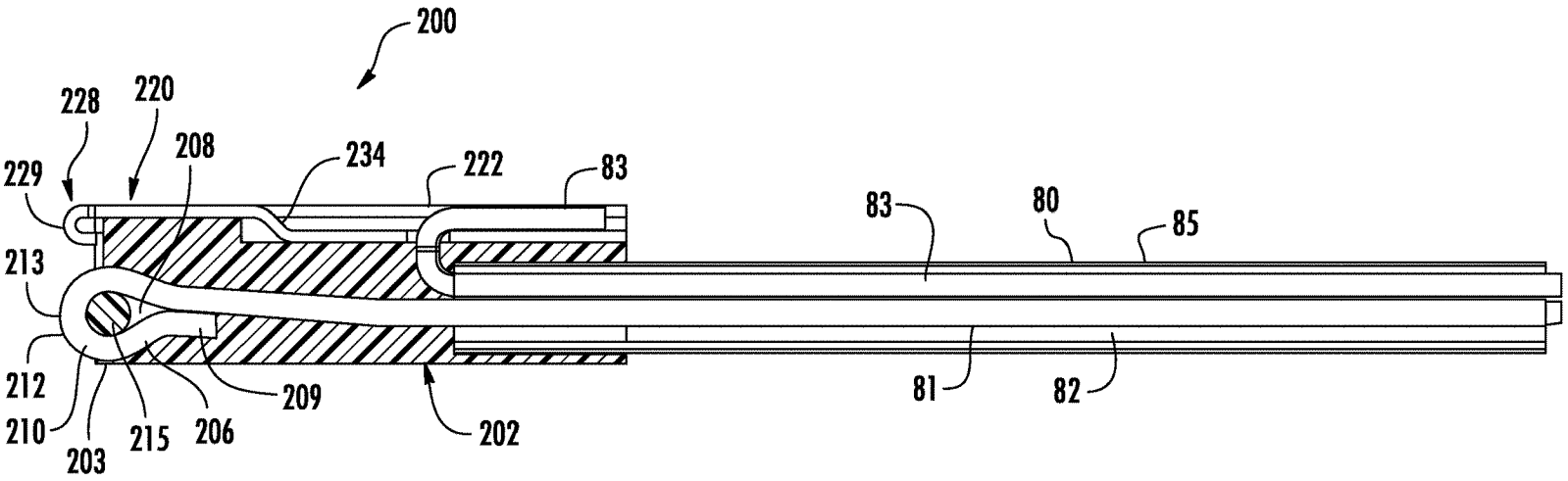
FIG. 9D is a lengthwise sectional view of the connector of FIG. 9, taken along lines D-D thereof.

FIGS. 9-9D illustrate one embodiment of a wire to board connector 200 in which the signal conductors 81 of each cable 80 extend through a corresponding connector body portion 202 of the connector 200. The signal conductors 81 have free ends 206 that extend out of their dielectric coverings 84 and which are configured to define signal terminals 210 with corresponding contact portions 212 that at least partially extend out of the connector body 202. As shown in this embodiment, which is utilized in vertical applications, a pair of signal terminals 210 with corresponding contact portions 212 extend slightly outwardly from a mating end 203 of the connector 200. The signal terminals 210 are in effect, a continuation of the signal conductors 81 of the cables 80 and extend lengthwise through the connector body 202. Hence, there is no need to use separate terminals with distinct tail portions. The signal terminal contact portions 212 can be seen to have generally C or U-shaped configurations when viewed from the side, as in FIGS. 9B & 9D. In this regard, the signal terminal contact portions 212 include arcuate contact surfaces 213 which are oriented crosswise, or transversely to a longitudinal axis LA of its connector 200.

The contact surfaces 213 have general U-shaped or C-shaped configurations, and they can ride upon the substrate contacts 54-2 when the connectors 200 are inserted into corresponding vertical openings 99*a* so as to contact the mating surface 64 of the substrate 53 in at least a point contact along the contacts 54-2. Although arcuate contact surfaces 213 of the connector terminals are shown in the illustrated embodiments, other configurations may work, provided that a least a linear point contact is maintained against the substrate contacts 54-2. In the illustrated embodiments, the free ends 206 of the signal conductors 81 are folded or bent back upon themselves as illustrated, as at 209, and in doing so, extend around a compliant member 215 with a cylindrical body portion 216 that is disposed widthwise within the connector body 202. The compliant member 215 is preferably formed from a elastomeric material with a durometer value chosen to accommodate the desired spring force for the contact portions 212. The compliant member 215 is shown as having a cylindrical configuration, but it will be understood that other configurations, such as square, rectangular, elliptical or the like may be used. The signal conductor free ends are bent such that they define an opening, or loop, 208 through which the complaint member 215 extends in the connector body 202 and the free ends 206 extend around at least more than half of the circumference of the compliant member body portion 216 in order to retain the compliant member 215 in place. Although the free ends 206 are shown folded back upon themselves, they could terminate earlier to define a J-shaped hook that engages the compliant member body portion 216 in a manner that prevents the compliant member 215 from working free from its engagement with the contact portions 212.

Figure 10:
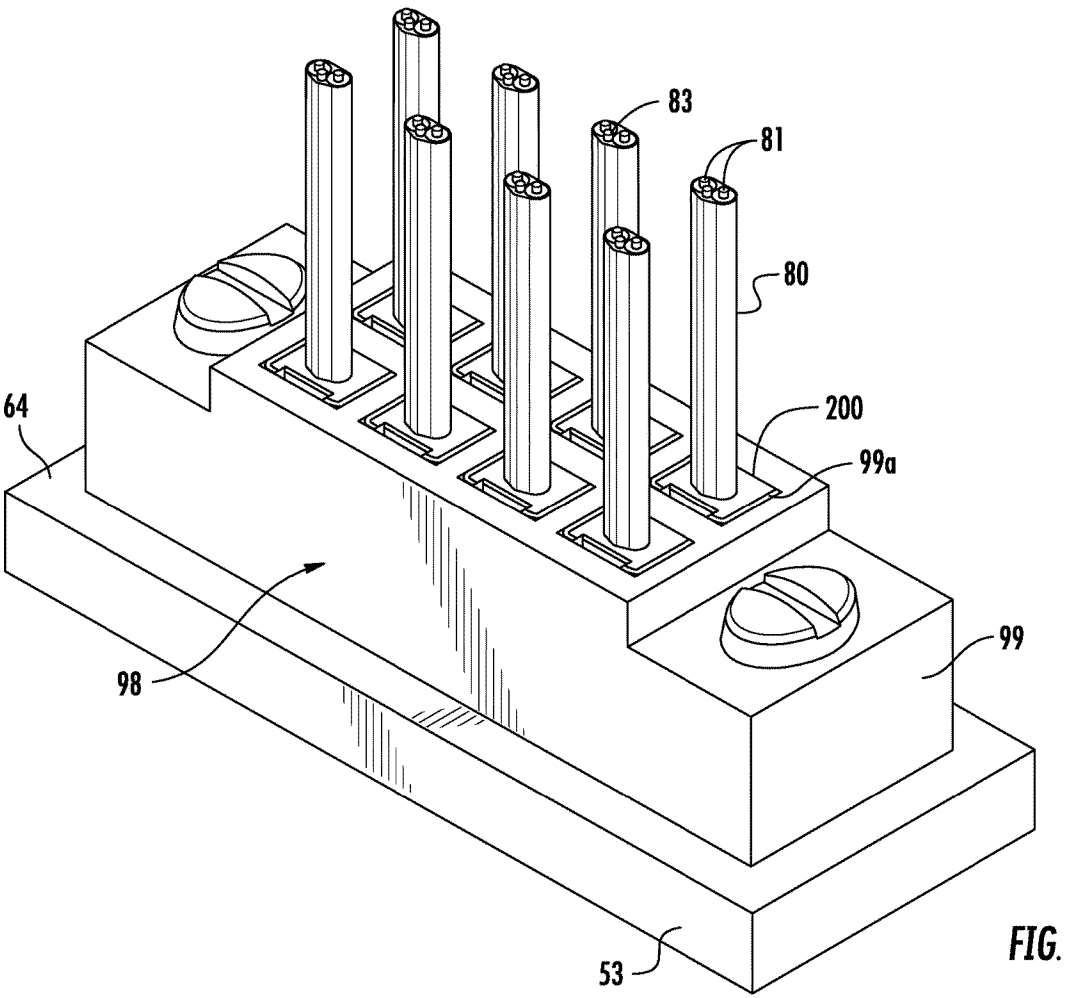
FIG. 10 is a perspective view of a vertical receptacle connector mounted to a circuit board and with connectors of FIG. 9 inserted therein.
Figure 11:
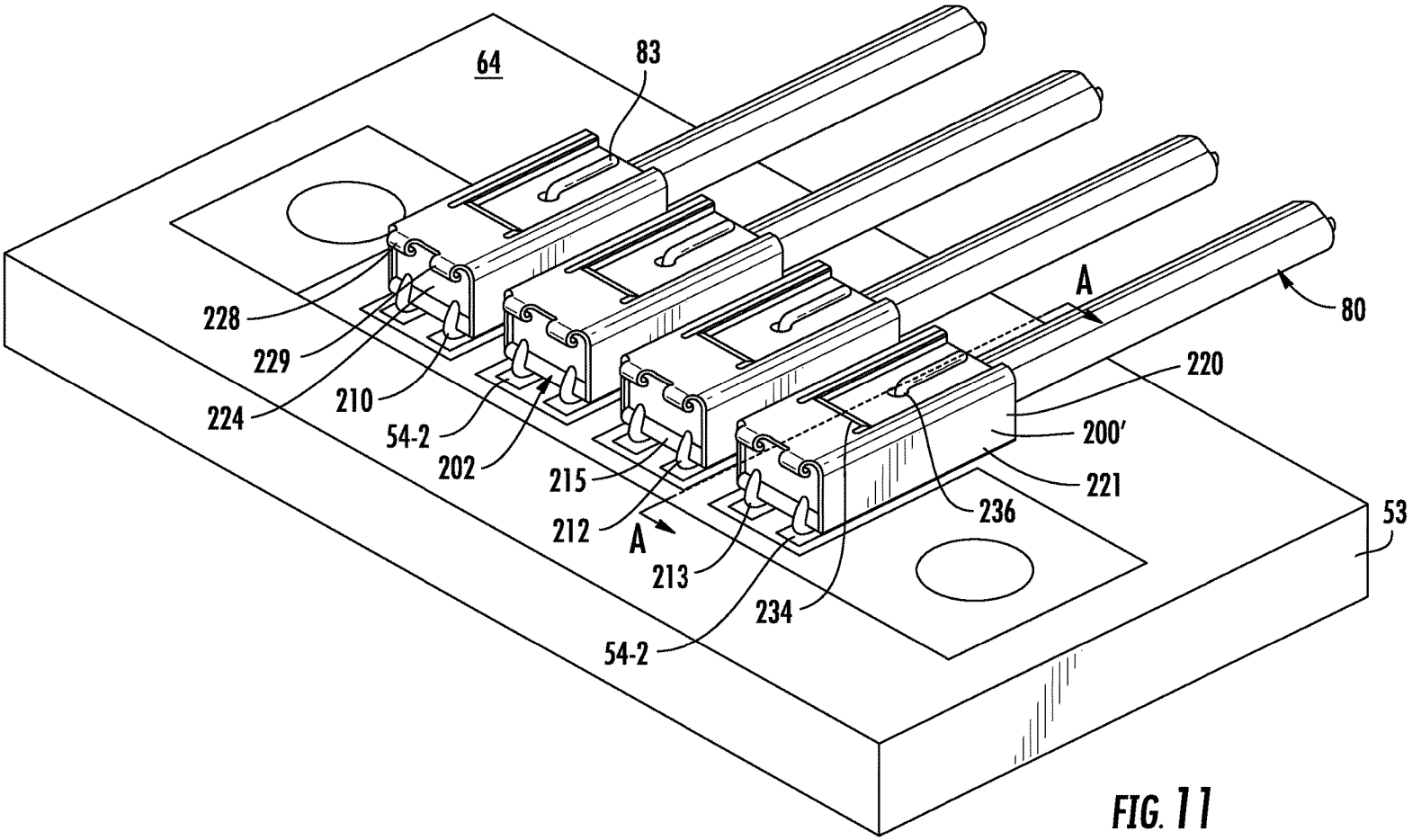
FIG. 11 is a perspective view of a the wire-to-board connector of FIG. 9 utilized in a horizontal orientation for contacting a chip package substrate.
Figure 11A:
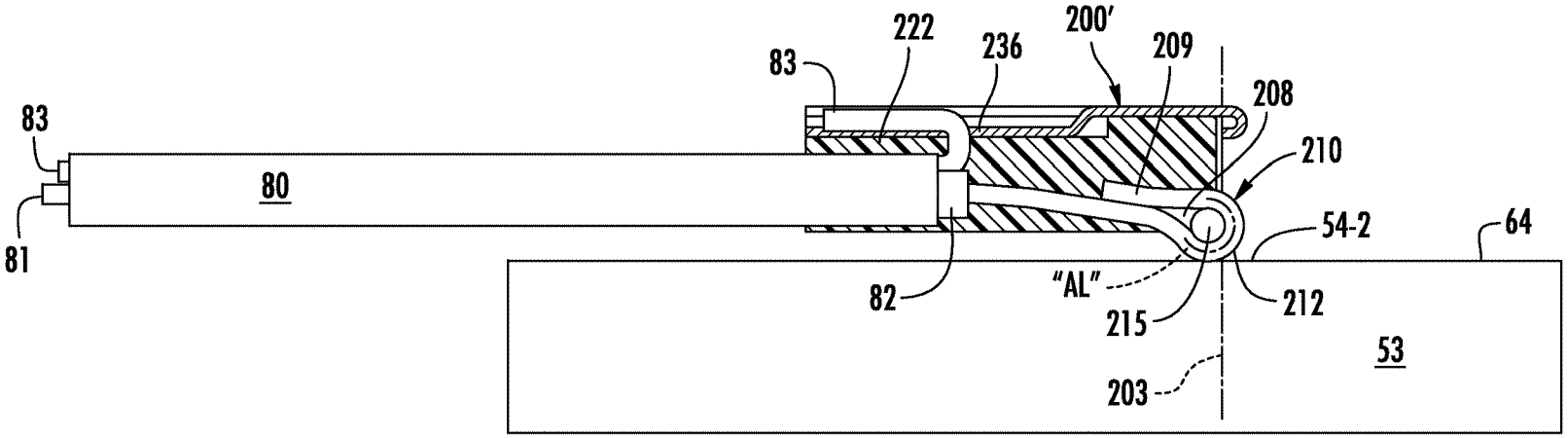
FIG. 11A is sectional view of one of the connectors of FIG. 11, taken along lines A-A thereof.
Figure 11B:
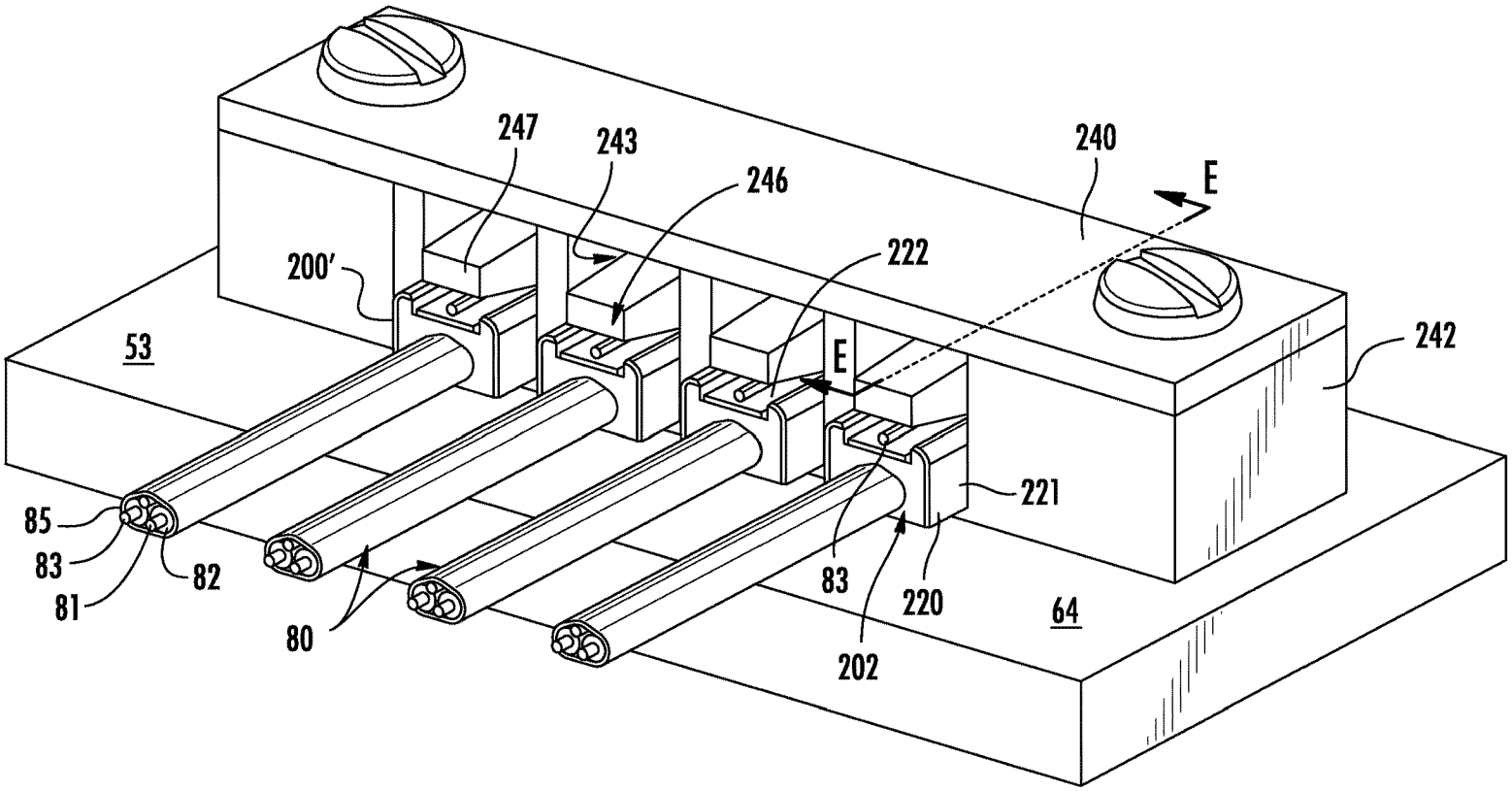
FIG. 11B is the same view as FIG. 11, but with a horizontal receptacle connector in place upon a chip package substrate and with connector chiclets in place.
Figure 11C:
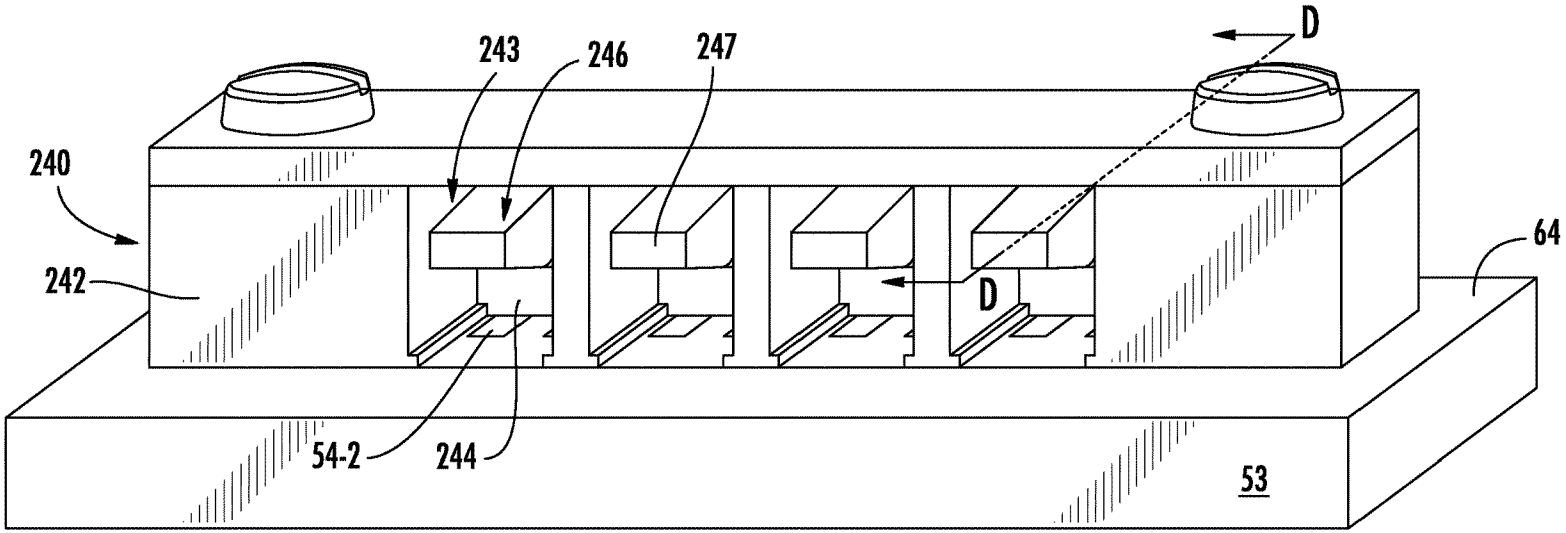
FIG. 11C is the same view as FIG. 11B, but with the connector chiclets removed for clarity.
Figure 11D:
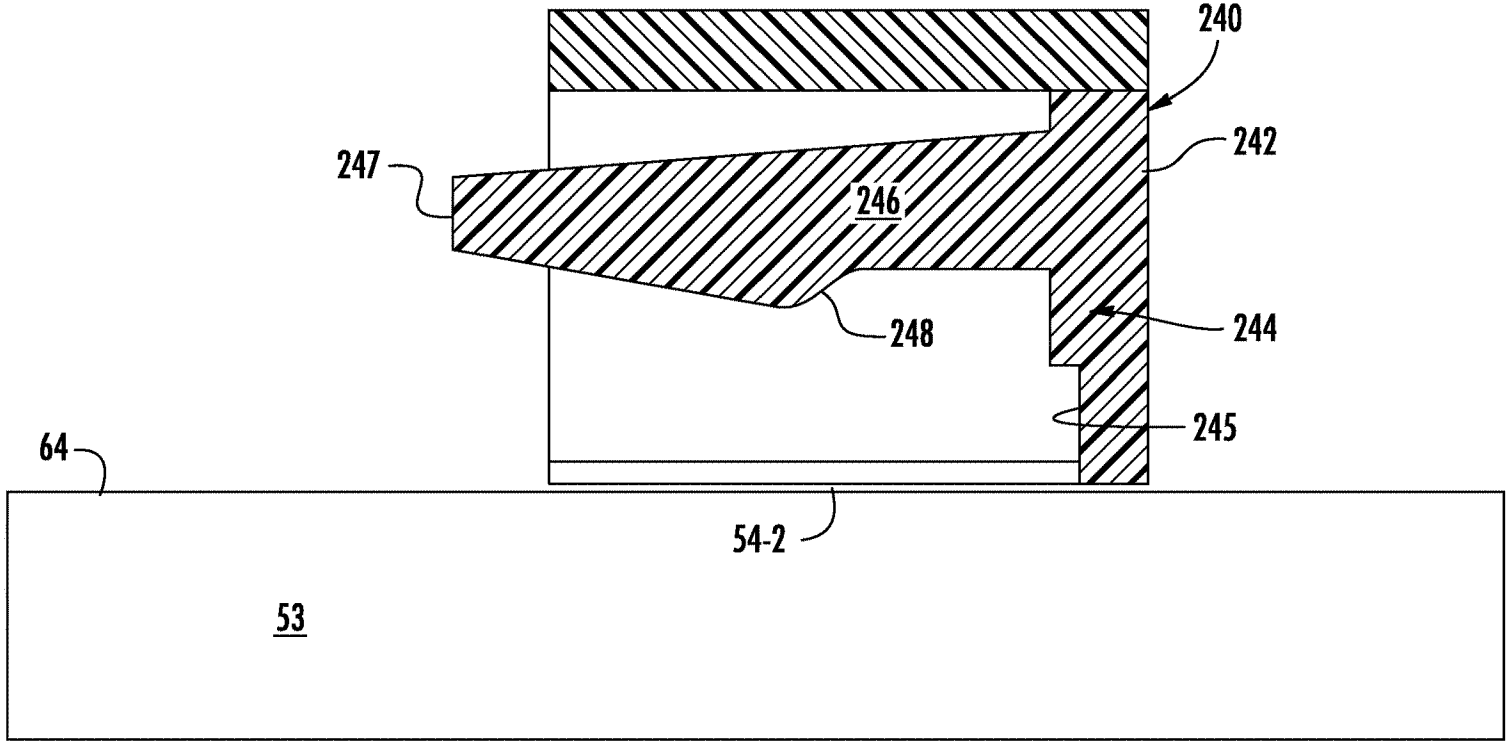
FIG. 11D is a sectional view of the receptacle connector of FIG. 11C, taken along lines D-D thereof; and, FIG. 11E is a sectional view of the receptacle connector assembly of FIG. 11B, taken along lines E-E thereof.

In the connector 200 of FIGS. 9-11, the pair of signal conductors 81 are arranged in a parallel spacing and formed about the compliant member 215. This assembly is inserted into a ground shield 220 shown in the Figures as having three walls 221, 222 and the drain wire 83 of the cable 80 is attached the ground shield 220 at one of the walls 222 in a known manner. The space 224 within the ground shield walls 221, 222 is filled with a dielectric material, such as LCP, to fix the signal terminals 210 and in place within the connector body 202 and to give the connector body 202 more definition. The signal terminal/conductors are arranged within the ground shield 220 as shown in FIG. 11B, with the ends 218 of the compliant member proximate to or engaging the side walls 221 of the ground shield 220 so that parts of the contact portions 212 extend past the mating face of the connector body. As seen in FIGS. 9A, 9B and 10A, a portion of the compliant member 215 extends past the mating face 203 of the connector 200, 200'. The ground shield 220 may include one or more ground terminals 228 with curved contact portions 229 that extend from an edge 226 of the ground shield 220, and the drain wire 83 of the signal pair of the cable 80 extends through an opening 236 in the ground shield wall 222 and bent back upon the wall 222 for attachment thereto in a known manner. The ground terminals 228 are aligned with each other in a first direction, and are further aligned with the two signal terminals 210 in second direction, transverse to the first direction.

Figure 11E:
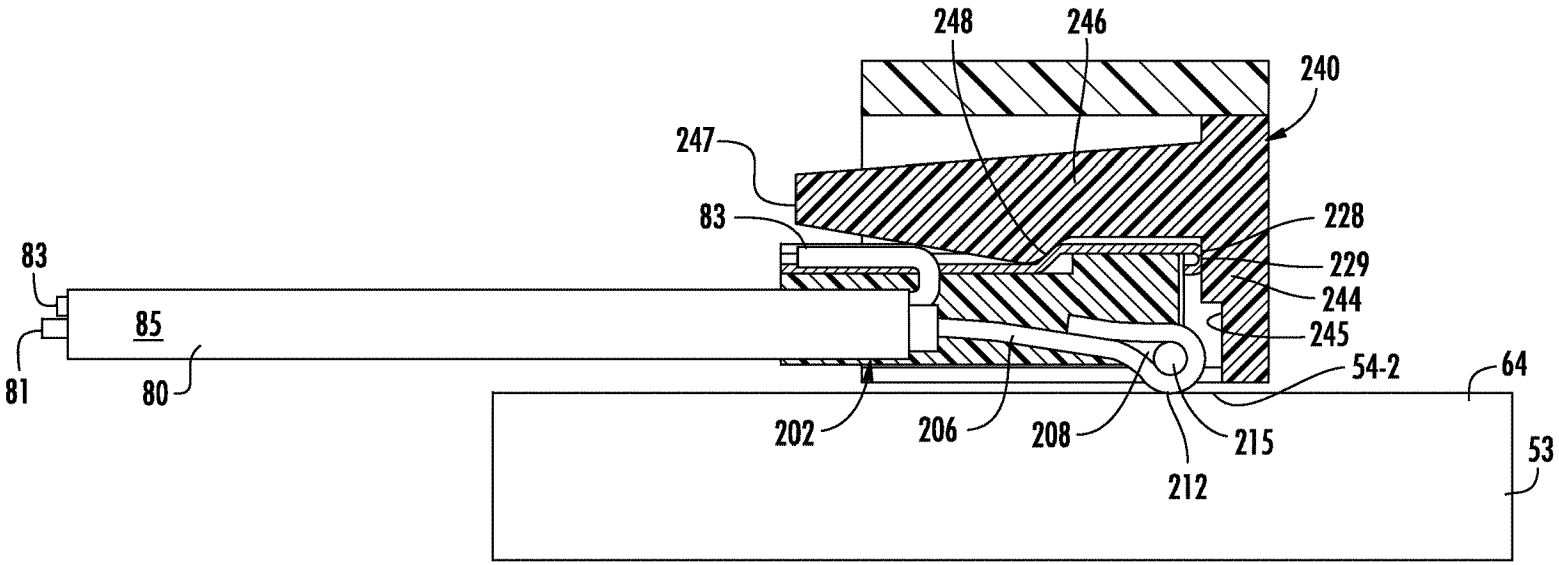

Such connectors 200 may be inserted into the openings 99*a* of the receptacle connectors 98 and held in place vertically in pressure engagement against the circuit board mating surface. This pressure may be applied by way of a press arm or angled walls of the receptacle openings 99*a*. Receptacle connectors 98 that receive connectors 200 in a vertical direction are shown in FIGS. 9 through 10, but FIGS. 11-11E illustrate a second embodiment of a wire to board connector 200' and a corresponding receptacle connector 240 constructed in accordance with the principles of the Present Disclosure. In this embodiment, the connectors 201' are structured for engagement with the substrate contacts in a horizontal orientation. In this regard, the overall structure of the connector 200 is much the same as that of the previously described embodiment. One difference is that the compliant member 215 is disposed proximate to a corner of the mating face 203 of the connector 200' as illustrated in FIG. 11A, so that more than half of the arc length AL of the signal terminal contact surfaces 213 are exposed outside of the connector body mating face 203.

In order to accommodate these type wire to board connectors 200', a horizontal receptacle connector 240 such as illustrated in FIG. 11B can be utilized. The depicted receptacle connector 240 has a base 242 for mounting to the mating surface 64 of a substrate 53. The base 242 has receptacle openings 243 as shown that are spaced apart along the width of the connector 240 and each opening 243 is configured to receive a single connector unit 200' therein. The openings 143 open directly to the substrate 53 so that its contacts are exposed within the openings 243 are proximate to the corners thereof so as to engage the signal terminal contact portions 212 of an inserted connector 200'. In this regard, the substrate mating surface 64 may be considered as defining a wall of the receptacle opening 243.

In order to apply a downward contact pressure on the signal terminal contact portions a cantilevered press arm, or latch 246, is shown formed as part of the connector 240. It extends forwardly within the opening 243 from a rear wall 244 thereof and terminates in a free end 247 that is manipulatable. It further preferably has a configuration that is complementary to that of one of the ground shield walls 222, as shown in FIG. 11E. The ground shield wall 22 of the connector 200' is offset to define a ridge 234 that engages an opposing shoulder 248 formed on the press arm 246. In this manner, the connector 200' is urged forwardly (FIG. 11E) so that the ground contacts 229 contact the end wall 244 of the receptacle opening 243 as well as urged downwardly so that its signal contact portions 212 contact the circuit board contact pads 64. At least the end wall 244 of the receptacle connector opening 243 is conductive, such as by way of a conductive coating and it is connected to ground circuits on the circuit board 62 in a known manner. The press arm 246 is also preferably conductive so that contact is made between the connector ground shield along at least two points in two different directions.

The receptacle connector 240 may further include in its openings 243, side rails 249 that extend lengthwise within the opening 243 along the mating surface of the circuit board 62. These rails 249 engage and support edges of the connector body 202 above the circuit board a desired distance that produces a reliable spring force against the contact portions 212 of the signal terminals 210 by the compliant member 215. It will be noted that the signal terminal contact portions 212 of the connector 200' make contact with their corresponding contact pads 64 in a horizontal direction, while the ground terminal contact portions 229 of the ground terminals 228 make contact ground circuits on the circuit board 62 in a vertical direction by virtue of their contact e vertical conductive surface 230 of the connector 240.

The Present Disclosure provides connectors that will preserve an ordered geometry through the termination to the circuit board that is present in the cable wires without the introduction of excessive noise and/or crosstalk and which will provide a wiping action on the contact pads to which they connect. The use of such bypass cable assemblies, permits the high speed data transmission in association with circuit boards made with inexpensive materials, such as FR4, thereby lowering the cost and manufacturing complexity of certain electronic devices. The direct manner of connection between the cable conductors and the circuit board eliminates the use of separate terminals which consequently reduces the likelihood of discontinuities, leading to better signal performance. This elimination of separate contacts also leads to an overall reduction in the system cost. Additionally, the compressibility of the compliant member 215 will ensure contact between at least the signal terminals and the circuit board contacts irrespective of areas of the circuit board which may be out of planar tolerance. It also permits the signal contact portions 212 to move slightly against the compliant member 215 to achieve a reliable spring force against the substrate contacts.

While preferred embodiments of the Present Disclosure have been shown and described, it is envisioned that those skilled in the art may devise various modifications without departing from the spirit and scope of the foregoing Description and the appended Claims.

We claim:

1. A board connector assembly for connecting to a chip package, comprising:

a cable including a pair of signal conductors and a ground wire;

a connector housing supporting a pair of signal terminals, each signal terminal having a contact portion and a termination portion and a body portion extending therebetween, the connector housing having a mating end, the termination portions being enclosed in the connector housing and the contact portions being disposed exterior of the connector housing and spaced apart from the connector housing mating end;

a ground member supported by the connector housing and extending along at least a portion of the terminal body portions, the ground member including a termination portion for connecting to the ground wire and electrically connected to a ground contact portion, the ground contact portion extending from the connector housing such, and the signal contact portions and the ground contact portions including arcuate contact surfaces at distal ends such that when the connector housing is pressed toward a mating surface of a circuit board, pairs of the terminal contact portions move transversely along the circuit board common mating surface transversely to the connector housing longitudinal axis.

2. The board connector assembly of claim 1, wherein the ground contact portion is a pair of ground contact portions and the signal and ground contact portions are arranged in pairs of signal and ground contact portions in a first direction and in pairs of signal and ground contact portions in a second direction.

3. The board connector assembly of claim 2, wherein the first and second directions are transverse to each other.

4. The board connector assembly of claim 2, wherein all of the signal and ground member terminal contact portion arcuate contact surfaces extend in the second direction.

5. The board connector assembly of claim 1, wherein the connector housing includes at least one engagement surface disposed transversely to the connector housing longitudinal axis configured to engage a stop surface of a corresponding connector guide block into which the connector housing may be inserted.

6. The board connector assembly of claim 1, wherein the connector housing has four sides and two of the sides include engagement surfaces disposed thereon.

7. The board connector assembly of claim 1, wherein the connector housing ground member extends completely around the signal terminals.

8. The board connector assembly of claim 7, wherein the terminal contact surfaces extend transversely to the connector housing ground member.

9. The board connector assembly of claim 8, wherein the signal and ground terminal contact surfaces have generally C-shaped or U-shaped configurations.

10. The board connector assembly of claim 1 wherein when the connector housing mating end is pressed against a surface of a circuit board, the signal and ground terminal member terminals move in a transverse direction to the connector housing longitudinal axis and away from a centerline of the connector housing.

11. The board connector assembly of claim 1, wherein the signal and ground terminal contact portions have a J-shaped configuration and wherein the J-shapes are formed from compound curves.

12. The board connector assembly of claim 11, wherein the signal and ground terminals include inflection points disposed between the contact and body portions of the signal and ground terminals.

13. The board connector assembly of claim 1, wherein the signal terminal contact portions are edge coupled to each other and are broadside coupled to the ground member.

14. A bypass cable assembly for connecting circuits of a chip package of a host device to external connector interfaces of the host device, comprising:

a chip package including a substrate supporting at least one integrated circuit, the substrate including circuitry extending between leads of the integrated circuit and contacts of the substrate;

at least one bypass cable, the bypass cable including a pair of signal conductors extending lengthwise through an insulative body portion, the signal conductors being separated by a first spacing within the insulative body portion, and a ground wire extending lengthwise through the bypass cable, each signal conductor and ground wire having opposing proximal and distal free ends;

distal free ends of the signal conductors and ground wires being terminated to the host device external connector interfaces, and proximal free ends of the signal conductors and ground wires to a chip package connector that is matable with the chip package substrate contacts; and, the chip package connector including a connector housing supporting a pair of conductive signal terminals extending lengthwise through the connector housing and aligned with a longitudinal axis of the connector housing, the signal terminals including tail portions to which the proximal free ends of the bypass cable signal conductors and ground wires are terminated, the signal terminals further including contact portions with contact surfaces offset from the connector housing longitudinal axis;

the connector housing further including a shield supported therein to at least partially encircle portions of the signal terminals proximate to the signal terminal contact portions, the shield including a pair of ground terminals extending therefrom and out of the connector housing, the ground terminals further including contact portions with contact surfaces offset from the connector housing longitudinal axis, the signal and ground terminals being aligned so that when a mating face of the connector is pushed against a common mating surface of the chip package substrate, the contact portions move outwardly along the circuit board mating surface to provide a linear wiping action along the chip package substrate common mating surface.

15. The bypass cable assembly of claim 14, wherein the signal and ground terminals have a first width and the contact portions thereof have a second width which is greater than the first width.

16. The bypass cable assembly of claim 14, further including a connector block configured for mounting to the chip package substrate common mating surface, the connector block including at least one opening configured to receive the connector housing therein.

17. The bypass cable assembly of claim 16, wherein the connector block includes at least one stop surface in opposition to the circuit board mating surface and the connector housing includes at least one engagement shoulder disposed in opposition to the connector block one stop surface, the one stop surface and engagement shoulder cooperating to maintain the connector housing signal and ground terminal contact portions in contact with the chip package substrate common mating surface.

18. The bypass cable assembly of claim 14, wherein the signal terminal contact portions are arranged in a first row and the ground terminal contact portions are arranged in a second row along the connector housing mating face.

19. The bypass cable assembly of claim 18, wherein one of the signal terminal contact portions and one of the ground terminal contact portions are arranged in a third row that intersects the first and second rows.

20. The bypass cable assembly of claim 19, wherein the other of the signal terminal contact portions and the other of the ground terminal contact portions are arranged in a fourth row that intersects the first and second rows, the third and fourth rows being spaced apart.

21. The bypass cable assembly of claim 14, further including additional bypass cables which include pairs of signal conductors extending lengthwise therethrough, and individual ground wires associated with each additional bypass cable wire pair, the signal and ground wires having opposing first and second free ends;

distal free ends of the signal and ground wires of the additional bypass cables being terminated to the external connector interfaces, and each of the additional bypass cables having additional chip package connectors terminated to proximal free ends of their respective signal and ground wires;

the additional chip package connectors including connector housings supporting pairs of conductive signal terminals extending lengthwise therethrough, aligned with longitudinal axis of respective ones of the connector housings, the signal terminals including contact portions with contact surfaces offset from the longitudinal axes of the additional connector housings;

the additional connector housings including shields which at least partially encircle portions of pairs of the signal terminals proximate to the contact portions of the signal terminals, the shields including pairs of ground terminals extending from the additional connector housings with contact portions having contact surfaces offset from respective additional connector housing longitudinal axes, the signal and ground terminal contact portions being configured to move in a linear wiping action along the chip package substrate common mating surface when mating faces of the additional connector housings are pushed thereagainst in directions normal to the wiping action.

22. A bypass cable assembly for connecting circuits of a chip package to an external connector interfaces of a host device, comprising:

a chip package including a substrate supporting at least one integrated circuit, the substrate including circuitry extending between the integrated circuit and contacts on the chip package substrate, the chip package substrate including a plurality of receptacles disposed thereon and aligned with the chip package substrate contacts;

a plurality of bypass cables, each bypass cable including a pair of signal conductors surrounded by a dielectric body, the signal conductors being spaced apart from each other in a first spacing within the bypass cable body, and a ground wire associated with each pair of signal conductors, each of the signal conductors and ground wire having opposing first and second free ends;

distal ends of the signal conductors and ground wires being connected to the host device external connector interfaces;

proximal ends of the signal conductors and ground wires being connected to board connectors matable with the chip package substrate contacts and configured to engage the chip package receptacles, each of the board connectors including a housing and a compliant member supported within the housing, a pair of conductive signal terminals extending lengthwise in the housing, the signal terminals including contact portions extending at least partially out of the housing, the signal terminal contact portions being aligned together in opposition to the chip package contacts and further deflectably supported by the compliant member; and, wherein each housing includes a ground shield that at least partially encircles portions of the signal terminals proximate to said signal terminal contact portions, the ground shield including a pair of ground terminals extending therefrom out of said connector housing, the ground terminals further including contact portions with contact surfaces aligned with the signal terminal contact surfaces.

23. The bypass cable assembly of claim 22, wherein the housing has at least four sides and the ground shield has at least three sides.

24. The bypass cable assembly of claim 22, wherein each chip package receptacle includes at least one opening surrounding the chip package contacts, the opening including a rear wall with a conductive surface which is contacted by the connector ground terminal contact portions when the board connector is fully inserted into the one opening.

25. The bypass cable assembly of claim 24, wherein the chip package receptacle opening includes a flexible latching arm that engages the housing, the latching arm being cantilevered from the chip package receptacle so as to exert a downward contact pressure on the housing to maintain the housing signal conductor and ground terminal contact portions in contact with the chip package contacts.

26. The bypass cable assembly of claim 22, wherein the signal terminal contact portions are arranged in a first row and the ground terminal contact portions are arranged in a second row along a mating face of the board connector, the first and second rows being spaced apart such that single signal terminal contact portions are aligned with corresponding single ground terminal contact portions.

* * * * *